US010376885B2

(12) United States Patent
Cheng et al.

(10) Patent No.: US 10,376,885 B2
(45) Date of Patent: Aug. 13, 2019

(54) MICROFLUIDIC CONCENTRATOR FOR LABEL-FREE, CONTINUOUS NANOPARTICLE PROCESSING

(71) Applicant: Lehigh University, Bethlehem, PA (US)

(72) Inventors: Xuanhong Cheng, Bethlehem, PA (US); Chao Zhao, Shanghai (CN); Alparslan Oztekin, Center Valley, PA (US)

(73) Assignee: LEHIGH UNIVERSITY

( * ) Notice: Subject to any disclaimer, the term of this patent is extended or adjusted under 35 U.S.C. 154(b) by 160 days.

(21) Appl. No.: 15/343,784

(22) Filed: Nov. 4, 2016

(65) Prior Publication Data

US 2017/0120248 A1 May 4, 2017

Related U.S. Application Data

(60) Provisional application No. 62/250,530, filed on Nov. 4, 2015.

(51) Int. Cl.

| | |
|---|---|
| ***B01L 3/00*** | (2006.01) |
| ***B01L 7/00*** | (2006.01) |
| *B01F 5/00* | (2006.01) |

(52) U.S. Cl.

CPC ... *B01L 3/502761* (2013.01); *B01L 3/502746* (2013.01); *B01L 7/54* (2013.01); *B01L 2300/185* (2013.01); *B01L 2300/1822* (2013.01); *B01L 2400/0451* (2013.01); *B01L 2400/086* (2013.01); *B01L 2400/088* (2013.01)

(58) Field of Classification Search

CPC ..... B01L 2300/1822; B01L 2300/185; B01L 2400/0451; B01L 2400/086; B01L 2400/088; B01L 3/502746; B01L 3/502761; B01L 7/54; G03G 15/0818; G03G 2215/0619; G03G 2215/0641

See application file for complete search history.

(56) References Cited

U.S. PATENT DOCUMENTS

| | | | |
|---|---|---|---|
| 6,274,089 | B1 | 8/2001 | Chow et al. |
| 6,318,970 | B1 | 11/2001 | Backhouse |
| 7,032,608 | B2 | 4/2006 | Koeneman et al. |
| 7,169,251 | B2 | 1/2007 | Guo et al. |

(Continued)

FOREIGN PATENT DOCUMENTS

| | | |
|---|---|---|
| CN | 102240534 | 11/2011 |
| CN | 102527280 | 7/2012 |

(Continued)

OTHER PUBLICATIONS

English translation; Chinese Publication No. CN102240534, published Nov. 16, 2016; 8 pages.

(Continued)

*Primary Examiner* — Jennifer Wecker

(74) *Attorney, Agent, or Firm* — The Belles Group, P.C.

(57) ABSTRACT

Disclosed herein are apparatuses comprising, for example, a microfluidic channel device comprising a main body comprising a channel configured to provide for helical fluid motion of material within the channel; and a temperature control system that applies a temperature gradient to the channel. Methods of making and using the apparatus are also described.

16 Claims, 26 Drawing Sheets

(56) References Cited

U.S. PATENT DOCUMENTS

| | | | | |
|---|---|---|---|---|
| 8,486,833 | B2 | 7/2013 | Bruzewicz et al. | |
| 8,815,778 | B2 | 8/2014 | Jung et al. | |
| 9,388,374 | B2 | 7/2016 | Hung et al. | |
| 2002/0166800 | A1 | 11/2002 | Prentiss et al. | |
| 2004/0262223 | A1* | 12/2004 | Strook | B01F 5/061 210/634 |
| 2005/0016851 | A1 | 1/2005 | Jensen et al. | |
| 2005/0129580 | A1* | 6/2005 | Swinehart | B01F 5/0475 422/400 |
| 2005/0287572 | A1 | 12/2005 | Mathies et al. | |
| 2007/0017633 | A1* | 1/2007 | Tonkovich | B01F 5/0611 156/300 |
| 2007/0243522 | A1 | 10/2007 | Sasaki et al. | |
| 2007/0266776 | A1* | 11/2007 | Liberatore | G01N 11/142 73/54.23 |
| 2008/0131323 | A1 | 6/2008 | Kuczenski et al. | |
| 2008/0227185 | A1 | 9/2008 | Schonfeld et al. | |
| 2008/0286482 | A1 | 11/2008 | Cheung et al. | |
| 2008/0305011 | A1 | 12/2008 | Hwang et al. | |
| 2009/0098029 | A1* | 4/2009 | Szalay | B81C 1/0046 422/198 |
| 2009/0148910 | A1 | 6/2009 | Korampally et al. | |
| 2010/0200092 | A1 | 8/2010 | Beltram et al. | |
| 2010/0297745 | A1 | 11/2010 | Li et al. | |
| 2010/0298602 | A1 | 11/2010 | Sultana et al. | |
| 2014/0030788 | A1 | 1/2014 | Chen et al. | |
| 2014/0065660 | A1 | 3/2014 | Kim et al. | |
| 2014/0065702 | A1* | 3/2014 | Tsai | B01L 7/52 435/286.1 |
| 2014/0134623 | A1* | 5/2014 | Hiddessen | G01N 1/38 435/6.12 |
| 2014/0315213 | A1 | 10/2014 | Nagrath et al. | |
| 2015/0352547 | A1 | 12/2015 | Breinlinger et al. | |
| 2015/0361419 | A1 | 12/2015 | Kim et al. | |
| 2016/0166186 | A1 | 6/2016 | Ferguson et al. | |

FOREIGN PATENT DOCUMENTS

| | | |
|---|---|---|
| CN | 104923324 | 9/2015 |
| EP | 2799535 | 5/2014 |

OTHER PUBLICATIONS

English translation; Chinese Publication No. CN102527280, published Jul. 4, 2012; 9 pages.
English translation; Chinese Publication No. CN104923324, published Sep. 23, 2015; 8 pages.

* cited by examiner

MICROFLUIDIC CONCENTRATOR FOR LABEL-FREE, CONTINUOUS NANOPARTICLE PROCESSING

CROSS REFERENCE TO RELATED APPLICATION(S)

This application claims priority to U.S. provisional patent application No. 62/250,530, filed on Nov. 4, 2015, which is hereby incorporated herein by reference in its entirety.

BACKGROUND

Enriching nanoparticles in an aqueous solution is commonly practiced for various applications. Despite recent advances in microfluidic technologies, a general method to concentrate nanoparticles in a microfluidic channel in a label free and continuous flow fashion is not yet available, due to strong Brownian motion on the nanoscale. Recent research of thermophoresis indicates that thermophoretic force can overcome the Brownian force to direct nanoparticle movement. Coupling thermophoresis with natural convection on the microscale has been shown to induce significant enrichment of biomolecules in a thermal diffusion column. However, the column operates in a batch process, and the concentrated samples are inconvenient to retrieve. The present inventors have recently designed a microfluidic device that combines a helical fluid motion and simple one-dimensional temperature gradient to achieve effective nanoparticle focusing in a continuous flow. The helical convection is introduced by microgrooves patterned on the channel floor, which directly controls the focusing speed and power. Here, COMSOL (software, Burlington, Mass.) simulations are conducted to study how the device geometry and flow rate influence transport and subsequent nanoparticle focusing, with a constant temperature gradient. The results demonstrate a complex dependence of nanoparticle accumulation on the microgroove tilting angle, depth, and spacing, as well as channel width and flow rate. Further dimensional analyses reveal that the ratio between particle velocities induced by thermophoretic and fluid inertial forces governs the particle concentration factor, with a maximum concentration at a ratio of approximately one. This simple relationship provides fundamental insights about nanoparticle transport in coupled flow and thermal fields. The study also offers a useful guideline to the design and operation of nanoparticle concentrators based on combining engineered helical fluid motion subject to phoretic fields. Using the optimal device geometry and operation condition, nanoparticle enrichment in a simple flow-through process is further demonstrated in a microfluidic channel.

More specifically, enriching nanoparticles in an aqueous solution is a critical step for the preparation of nanomaterials and detection of nano-analytes. While conventional methods such as high-speed centrifugation and ultrafiltration are effective, these batch processes require bulky instruments, extensive infrastructure and long processing time. Yields of such devices are often variable due to aggregation associated with pelleting or caking. Recent advances in lab-on-a-chip technologies have led to the development of portable microfluidic devices for microparticle separation and concentration, employing various physical mechanisms such as centrifugation, inertia-driven flow, dielectrophoresis, optical trapping and acoustophoresis. However, these approaches are mostly ineffective for nanoparticle processing due to scaling of the involved forces with the particle volume and strong Brownian motion of submicron and nanometer-sized species. Microfluidic filtration devices based on the size exclusion principle face similar challenges to their macroscopic counterparts, such as clogging and high back pressure. Capillary electrophoresis, including recent development utilizing the ion concentration polarization phenomenon, is popular for biomolecule purification and enrichment. Unfortunately, the high electric field is detrimental to vesicles and organisms. Affinity capture on solid beds or by magnetic particles 1 have been successfully demonstrated to separate nanovesicles and viruses, but the requirement of affinity interaction limits their application to species with unknown surface biochemistries. A general method to focus nanoparticles physically in a microfluidic channel in a label free and continuous flow fashion is not yet available.

Recently, thermophoresis has been proposed as a physical strategy to control the migration of molecules and colloid particles in aqueous solutions. Thermophoresis refers to the migration of solute species under a temperature gradient. It has long been studied as a means for atomic and molecular enrichment. Initially, thermophoresis was applied to species in the gas phase, and shown to concentrate isotopes when it is coupled with natural convection in a thermal diffusion column. Only in the past few decade has thermophoresis been investigated carefully in the aqueous phase, and newly demonstrated applications include colloidal crystallization, droplet and bubble manipulation as well as molecular assembly. Employing a thermal diffusion column, researchers predicted concentration enhancement of macromolecules by order of magnitude in the liquid phase, and empirically observed enrichment of DNA, organic compounds and polymers.

A thermal diffusion column, however, operates in a batch process. It is a closed, vertical capillary tube with a large aspect ratio, and a temperature gradient is generated across the capillary width. A thermophobic species in the column migrates along the temperature gradient to the cold wall. At the same time, thermal expansion of the solvent introduces natural convection that sweeps solute along the cold wall, and recirculation of the solute is inhibited by the thermophoretic force. As a result, the solute accumulates at a corner where drag forces are low. The steady state could be reached as drag, Brownian and thermophoretic forces are balanced. The local concentration has been found to increase by orders of magnitude compared to the bulk. The steady-state concentration factor scales exponentially with the temperature difference and aspect ratio. However, since the temperature gradient controls both the thermophoretic motion and natural convection, it is difficult to study the interplay of the two transport mechanisms and optimize the enrichment, as well as to extract the concentrated species from the capillary.

As mentioned above, conventional methods use temperature gradients to increase the concentration of macromolecules. However, their throughput is often low because they are batch processes. Two conventional processes—convection and thermophoresis—are driven by temperature gradients; but they make it difficult to separately control the two transport processes, which also limits the throughput. In addition, the temperature gradient is limited to small volumes heated by a laser, which is the enrichment location, and it is difficult to retrieve the concentrated species.

Others have used both electrodes and fluids to generate a temperature gradient. Without engineered convection, the concentration effect happens in one dimension and the enrichment factor is very low (on the order of 1).

Still others have described coupling temperature gradient with simple laminar flow to separate nanoparticles. These methods are only applicable to a plug flow, which results in a batch process with very limited sample volume. These approaches are useful for analysis, but not sample preprocessing, and are not practical for nanoparticle processing.

The present inventors have discovered a continuous approach to sample processing capable of higher throughput, focusing in two orthogonal directions (thus yielding high enrichment factors on the order of, for example, 10-100), separate and independent control of thermophoresis and convection (thus allowing optimization of both throughput and/or enrichment) and gentle operation conditions for biological species. This combination of features has not been delivered by methods heretofore described in the prior art.

The advances of nanotechnology demands new approaches to process nanoparticle samples in a easily-operable, scalable and portable fashion. Conventional methods, such as ultracentrifugation and ultrafiltration require bulky devices and/or extensive manual operations. Microfluidic technologies, albeit effective for processing microparticles, are limited for continuous, label-free enrichment of polymeric nanoparticles and biological nanovesicles, due to strong Brownian motion of nanospecies in solutions. Recent research of thermophoresis in aqueous solutions indicates that thermophoretic force can overcome Brownian force to direct nanoparticle movement in a biocompatible environment. Coupling thermophoresis with natural convection on the microscale has been shown to induce significant enrichment of biomolecules in a closed capillary called a thermal diffusion column, yet the column has many practical limitations for separation applications. Embodiments of the present invention present a microfluidic device that can concentrate submicron particles in a simple flow-through process. In an embodiment, the device couples an engineered helical flow and a mild, one-dimensional temperature gradient to achieve nanoparticle focusing. Here, the device geometry, flow rate and temperature gradient experimentally are optimized to enhance the focusing effect. As thermophoresis is ubiquitous in fluids, the approach applies universally to suspended soft nanoparticles without the need of labeling and allows continuous retrieval of concentrated species in a simple flow-through process. This microfluidic solution holds a promise to nanoparticle processing in resource-limited settings.

As such, there remains a need for apparatuses and methods of manufacturing and using the apparatuses which provide nanoparticle focusing by coupling thermophoresis and engineered vortex in a microfluidic channel which are able to overcome the above disadvantages. Embodiments of the present invention are designed to meet these needs.

SUMMARY

Some embodiments of the present invention provide an apparatus comprising: a microfluidic channel device comprising a main body which comprises a channel that allows for helical fluid motion of material within the channel; and a temperature control system that applies a temperature gradient to the channel.

Other embodiments provide a method of using an apparatus, the method comprising: providing a microfluidic channel device comprising a main body which comprises a channel that allows for helical fluid motion of material within the channel; providing a continuous flow of the material within the channel; and applying, using a temperature control system, a temperature gradient to the channel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The foregoing summary, as well as the following detailed description, will be better understood when read in conjunction with the appended drawings. For the purpose of illustration only, there is shown in the drawings certain embodiments. It's understood, however, that the inventive concepts disclosed herein are not limited to the precise arrangements and instrumentalities shown in the figures. The detailed description will refer to the following drawings in which like numerals, where present, refer to like items.

DETAILED DESCRIPTION

Figure 1A:
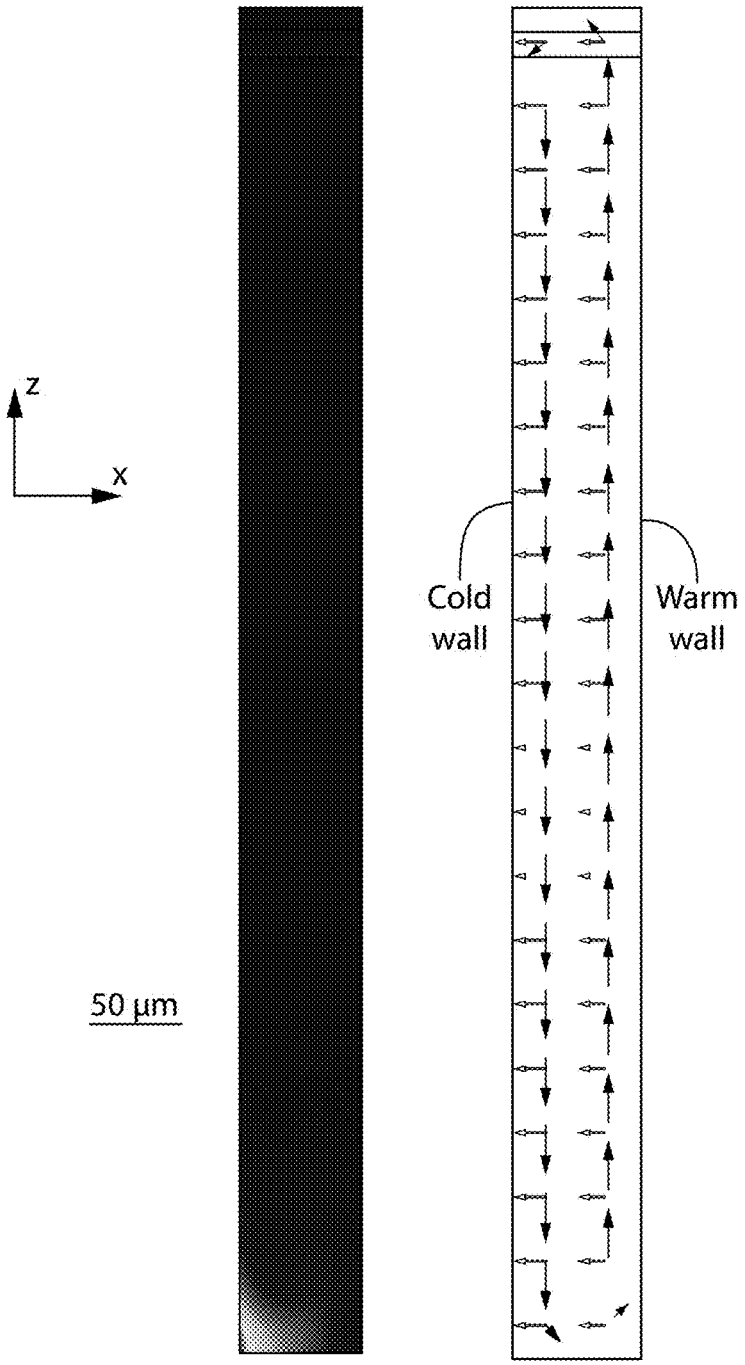
FIG. 1A (PRIOR ART)
FIG. 1A is a plot/schematic illustrating nanoparticles focusing by coupling thermophoresis and secondary flow in a conventional thermal diffusion column. The black arrows show the secondary flow velocity and the white arrows show thermophoretic velocity. The concentration contours demonstrate the focusing effect in 2D.

It is to be understood that the figures and descriptions of the present invention may have been simplified to illustrate elements that are relevant for a clear understanding of the present invention, while eliminating, for purposes of clarity, other elements found in a typical microfluidic channel device or typical method of using a microfluidic channel device. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Some embodiments of the present invention provide an apparatus comprising: a microfluidic channel device comprising a main body which comprises a channel that allows for helical fluid motion of material within the channel; and a temperature control system that applies a temperature gradient to the channel. In some embodiments, the channel comprises microgrooves that initiate and maintain the helical fluid motion of the material within the channel.

In some embodiments, the channel further comprises a rectangular cross-section that is perpendicular to a longitudinal directional of the channel. In some embodiments, the channel further comprises a bottom surface and a top surface, and wherein the microgrooves are located at the bottom surface or the top surface. In some embodiments, the channel is between 500 to 2000 mm in width. In some embodiments, the channel is between 50 to 100 μm in height. In some embodiments, the channel is between 1 to 40 cm in length. In some embodiments, some or all of these channel parameters may be combined.

In some embodiments, the microgrooves are spaced from each other a distance of 100 to 400 μm. In some embodiments, each microgroove is between 10 to 60 μm in height. In some embodiments, each microgroove is between 10 to 100 μm in width. In some embodiments, each microgroove is oriented at an angle between 25 to 65° with respect to a longitudinal direction of the channel. In some embodiments, some or all of these microgroove parameters may be combined.

In some embodiments, the microfluidic channel device further comprises: a bottom coverglass that covers a bottom surface of the main body; and a top coverglass that covers a top surface of the main body; wherein an inlet and outlet of the channel is provided in at least one of the bottom coverglass or the top coverglass.

In some embodiments, the temperature control system comprises a liquid coolant circulator connected to a pipe in contact with a top or bottom surface of the microfluidic channel device, and air circulator promoting heat transfer on the other surface.

In some embodiments, the temperature control system comprises: a bottom Peltier plate in contact with a bottom surface of the microfluidic channel device; and a top Peltier plate in contact with a top surface of the microfluidic channel device. In some embodiments, the bottom Peltier plate is set to a temperature in the range of −12 to 10° C., and wherein the top Peltier plate is set to a temperature in the range of 23 to 50° C.

Figure 24:
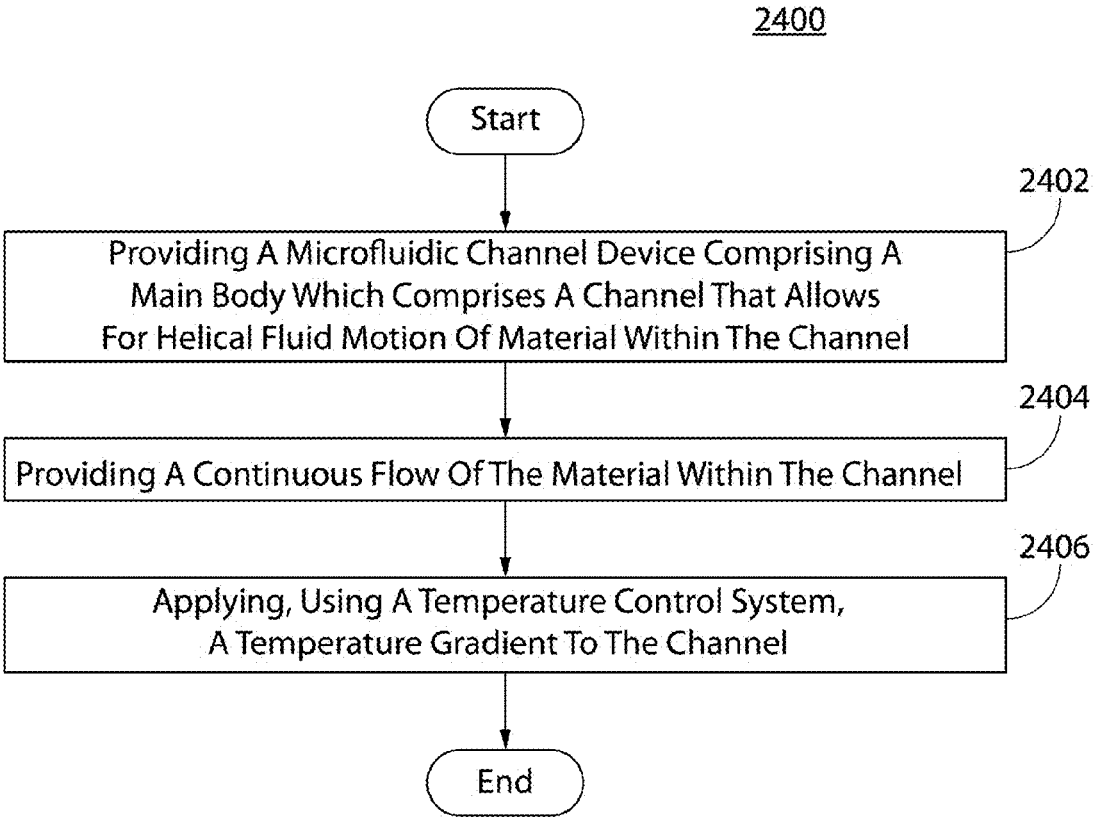
FIG. 24 is a flowchart illustrating an embodiment of a method of using an apparatus having a microfluidic channel device and a temperature control system.

Some embodiments of the present invention provide a method of using an apparatus having a microfluidic channel device and a temperature control system. FIG. 24 is a flowchart illustrating an embodiment of a method 2400 of using an apparatus having a microfluidic channel device and a temperature control system. The method 2400 comprising: providing a microfluidic channel device comprising a main body which comprises a channel that allows for helical fluid motion of material within the channel (block 2402); providing a continuous flow of the material within the channel (block 2404); and applying, using a temperature control system, a temperature gradient to the channel (block 2406). In some embodiments, the channel comprises microgrooves that initiate and maintain the helical fluid motion of the material within the channel.

In some embodiments of the method of using, the channel further comprises a rectangular cross-section that is perpendicular to a longitudinal directional of the channel. In some embodiments, the channel further comprises a bottom surface and a top surface, and wherein the microgrooves are located at the bottom surface or the top surface. In some embodiments, the channel is between 500 to 2000 mm in width. In some embodiments, the channel is between 50 to 100 μm in height. In some embodiments, the channel is between 1 to 40 cm in length. In some embodiments, some or all of these channel parameters may be combined.

In some embodiments of the method of using, the microgrooves are spaced from each other a distance of 100 to 400 μm. In some embodiments, each microgroove is between 10 to 60 μm in height. In some embodiments, each microgroove is between 10 to 100 μm in width. In some embodiments, each microgroove is oriented at an angle between 25 to 65° with respect to a longitudinal direction of the channel. In some embodiments, some or all of these microgroove parameters may be combined.

In some embodiments of the method of using, the microfluidic channel device further comprises: a bottom coverglass that covers a bottom surface of the main body; and a top coverglass that covers a top surface of the main body; wherein an inlet and outlet of the channel is provided in at least one of the bottom coverglass or the top coverglass.

In some embodiments of the method of using, the temperature control system comprises a liquid coolant circulator connected to a pipe in contact with a top or bottom surface of the microfluidic channel device, and air circulator promoting heat transfer on the other surface.

In some embodiments of the method of using, the temperature control system comprises: a bottom Peltier plate in contact with a bottom surface of the microfluidic channel device; and a top Peltier plate in contact with a top surface of the microfluidic channel device. In some embodiments, the method further comprises: setting a temperature in the range of −12 to 10° C. for the bottom Peltier plate; and setting a temperature in the range of 23 to 50° C. for the top Peltier plate.

Exemplary Embodiments

Materials and Methods of Some Embodiments:

PDMS microfluidic devices were fabricated using a standard soft lithography technique. In some embodiments, alternative fabrication techniques may be employed such as injection molding, hot embossing, 3D printing, micromachining, photolithography. First, using standard soft lithography, a two layer SU-8 photoresist was patterned on a silicon wafer by photolithography to form a negative mold. Next, a 10:1 mixture of poly(dimethylsiloxane) (PDMS) prepolymer and curing agent was spin-coated onto the wafer and baked at 60° C. until cured. After cutting and removing the PDMS channel from the SU-8 mold, the thin layer of PDMS channel was sandwiched and bonded permanently through oxygen plasma between two cover glass slides. One of the cover glass was laser-cut with holes serving as inlet and outlet. PDMS blocks were bonded to the holes on cover glass for tubing handling. In some embodiments, materials other than PDMS (e.g., plastic sheets, metal sheets, glass slides, glass covers, silicon wafers, etc.) may be employed as the main body of the microfluidic device. The thickness of the main body may be in the range of 50 μm and 100 μm. The cover slides may comprise materials other than glass such as metal sheets, silicon wafers, etc. The thickness of each cover slide may be in the range of 100 and 200 μm.

The channel may be completely embedded within the PDMS layer. In other words, the channel in the PDMS layer may be self-contained (i.e., embedded within the PDMS layer). In this configuration, the top and bottom cover slides may be optional and either or both may be included for structural rigidity purposes.

In an alternative configuration, the device would contain three layers: the PDMS layer in the middle would essentially be an open channel in a PDMS film. The microgrooves would be engraved in the PDMS film, preferably at the bottom surface of the PDMS channel in the PDMS film. The top and bottom cover slides are preferably smooth glass. One slide may be provided to seal the PDMS channel on the top surface of the PDMS layer (i.e., this top slide would effectively be the top surface of the channel). While the other slide is provided to support the opposite/bottom side of the PDMS layer ensuring the PDMS layer and entire structure does not deform. In another scenario where the cover slide(s) serve as either the top surface and/or the bottom surface of the channel, either or both cover slide(s) may alternatively contain the microgrooves.

As a further alternative, the groove and channel features may be alternatively provided on glass directly and capped with another piece of glass (i.e., bypassing the need for the intermediary PDMS layer). However, the inventors chose the glass-PDMS-glass structure because it requires the simplest fabrication steps. In fact, any method to make a rectangular channel with microgrooves on one wall/surface would be sufficient and the structure may be fabricated with any material having a decent thermal conductivity (e.g., metal and/or semiconductor).

After microfluidic channel fabrication, a temperature gradient was established by attaching the channel with a brass tube with cold water running inside. A thin film of silver-filled thermal conducting epoxy was used to enhance the thermal conductivity between the channel and brass tube. The other side of the sandwiched device was exposed to room temperature at around 28° C. with humidity controlled around 30%. The temperature gradient was measured and confirmed by using a temperature sensitive dye BCECF (2',7'-Bis-(2-Carboxyethyl)-5-(and-6)-Carboxyfluorescein) at 1 mM (i.e., 1 millimolar or 1 millimole/liter) in DI (deionized) water and by heat transfer simulation.

To demonstrate the principle of nanoparticles focusing by coupling thermophoresis and swirling, suspension containing 100 nm polystyrene nanoparticles at 1% or 0.03% (v/v) was introduced into the channel using a syringe pump. Scanning laser fluorescent confocal microscope was used for particle concentration measurement, and NanoDrop (i.e., UV-Vis absorption spectroscopy) was utilized to measure the nanoparticles concentration.

Simulation:

To understand the transport processes that control nanoparticle accumulation, numerical analysis was performed by a continuous phase model. The governing equations to describe natural convection are Boussinesq approximation and the mass conservation equation:

$$\frac{\partial u}{\partial t} + u \cdot \nabla u = -\frac{1}{\rho}\nabla p + \gamma \nabla^2 u + \alpha g(T - T_0)$$

$$\nabla \cdot (\rho u) = 0$$

where ρ is the fluid density, γ is the kinematic viscosity, t is the time, u is the fluid velocity, p is the pressure, α is the thermal expansion coefficient of the fluid, g is the gravitational acceleration and T is the temperature.

The conservation of energy is in the form $$\rho C_p \frac{\partial T}{\partial t} + \rho C_p u \cdot \nabla T = \nabla \cdot (k \nabla T)$$

where $C_p$ is the heat capacity of the fluid and k is the thermal conductivity of the fluid.

The mass transport equation includes the mass diffusion, advection and the effect of the thermophoresis:

$$\frac{\partial c}{\partial t} = \nabla \cdot (D_T c \nabla T + D \nabla c) - \nabla \cdot (uc)$$

where c is the concentration of the species.

The continuous phase model was implemented using COMSOL. The transport of species model was modified to include the thermophoretic flux term $D_T c \nabla T$ and solved together with laminar flow and heat transfer models. The channel is designed to have grooves on the bottom wall, and a temperature gradient is established as the temperature on top and bottom wall differs. Parameters corresponding to 100 nm polystyrene particles in water was used: the diffusion coefficient was set at 4.4 $\mu m^2/s$. The viscosity of water was set at 0.001 Pa·s, the density at 1000 $kg/m^3$, the heat capacity at 4.2 J/g·K, and the thermal conductivity at 0.6 W/m·K. Gravitational acceleration is 9.8 $m/s^2$.

Results:

FIG. 1A is a plot/schematic illustrating nanoparticles focusing by coupling thermophoresis and secondary flow in a conventional thermal diffusion column. The black arrows show the secondary flow velocity and the white arrows show thermophoretic velocity. The concentration contours demonstrate the focusing effect in 2D.

The proposed design is inspired by molecular enrichment in a thermal diffusion column, where a one-dimensional temperature gradient across a thin gap is coupled with a natural convection roll in the gap (FIG. 1A). Solute molecules or suspended nanoparticles are transported through three processes: thermophoretic flux that drives species to either the cold (thermophobic) or warm wall (thermophilic), flux from natural convection that sweeps species to a low shear corner, and diffusive flux that transports species out of the corner. At the steady state, concentration in the accumulation zone decays exponentially to the bulk, and the concentration factor increases exponentially with the product of Soret coefficient, temperature difference across the gap and aspect ratio of the gap.

Figure 1B:
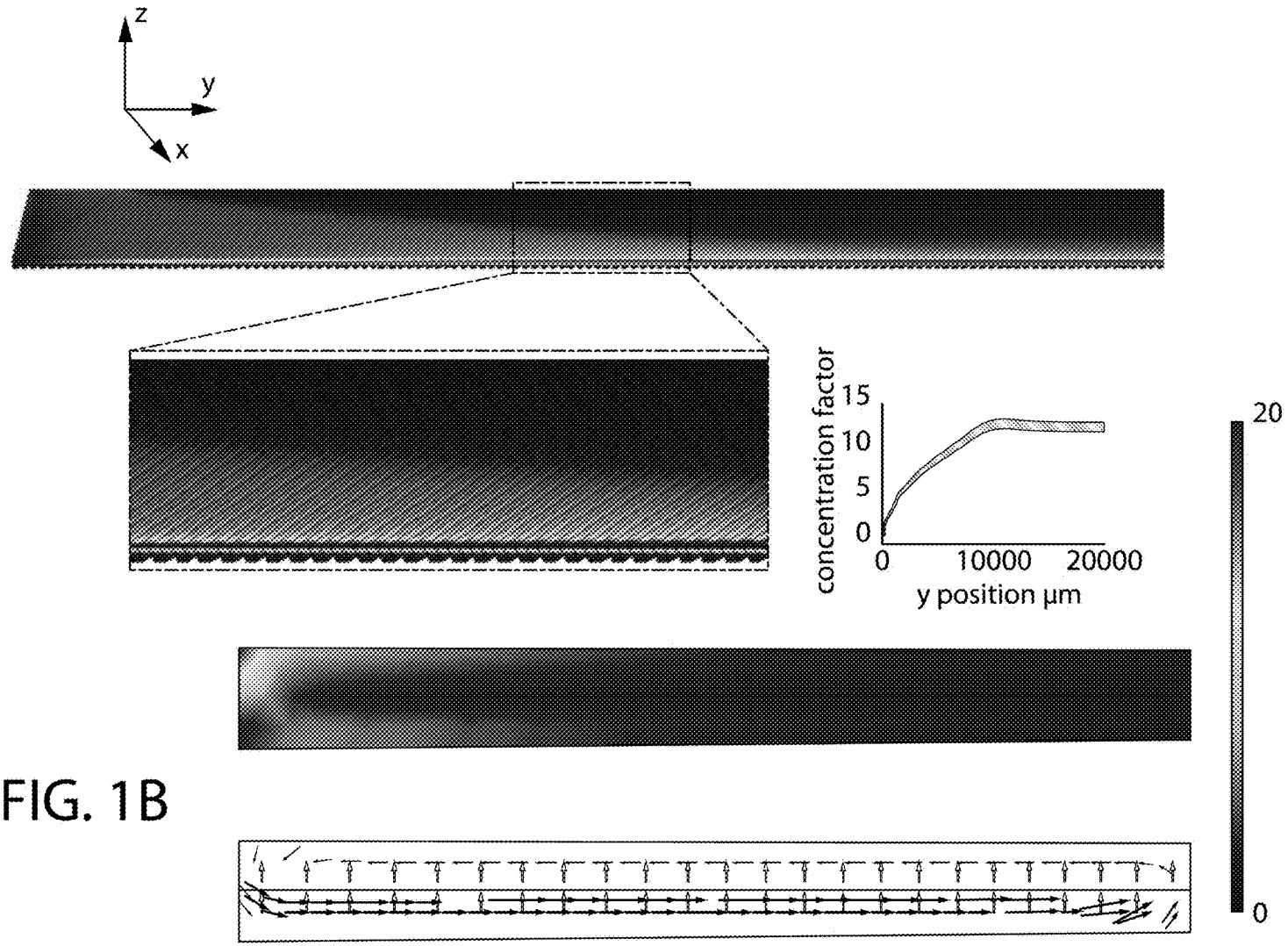
FIG. 1B is a plot/schematic illustrating nanoparticles focusing by coupling thermophoresis and secondary flow in a microfluidic channel. The black arrows show the secondary flow velocity and the white arrows show thermophoretic velocity in the transverse plane. The concentration contours demonstrate the focusing effect in 2D and 3D.

FIG. 1B is a plot/schematic illustrating nanoparticles focusing by coupling thermophoresis and secondary flow in a microfluidic channel. The black arrows show the secondary flow velocity and the white arrows show thermophoretic velocity in the transverse plane. The concentration contours demonstrate the focusing effect in 2D and 3D.

While a thermal diffusion column faces the challenge of batch processing and difficulty in receiving the samples, the present inventors propose to couple an engineered 3D helical transport with a one-dimensional temperature gradient in a microfluidic channel such that combined swirling and thermophoretic transport are created in the transverse plane (FIG. 1B). Numerical analysis shows that nanoparticles focus to one corner continuously. The focusing effect develops along the axial flow until a steady state is reached. The concentrated species can be retrieved continuously from a strategically positioned outlet, as opposed to batch processing in thermal diffusion column. Since thermo-migration is intrinsic to all solvated species, no labeling is required and particles remain suspended in the focusing process. This avoids aggregation associated with pelleting in centrifugation and caking in ultracentrifugation, both of which contribute to variable yields. Furthermore, the throughput is controllable by optimizing the device geometry, operation conditions and channel parallelization.

Figure 2:
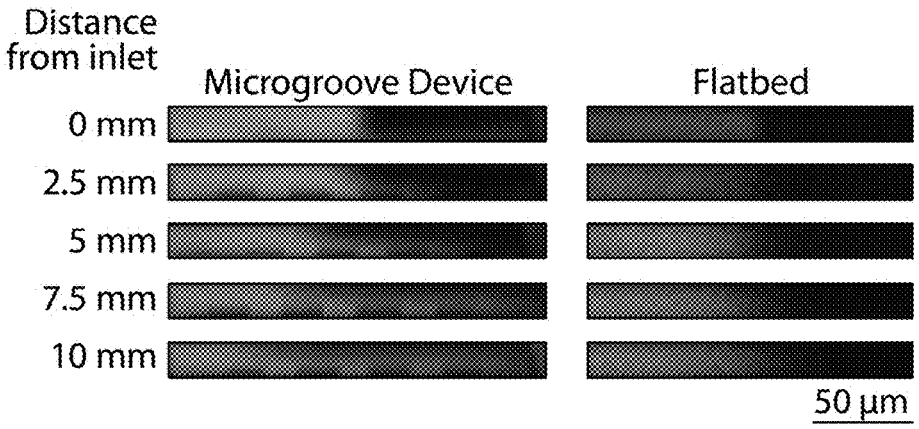
FIG. 2 is a plot illustrating three-dimensional helical transport introduced by micropatterned slanted grooves. In particular, the left and right sides of the figure depict a comparison between a channel with microgrooves (left-side) and a flatbed channel (right-side) to verify lateral convection induced by slanted grooves.

FIG. 2 is a plot illustrating three-dimensional helical transport introduced by micropatterned slanted grooves. In particular, the left and right sides of the figure depict a comparison between a channel with microgrooves (left-side) and a flatbed channel (right-side) to verify lateral convection induced by slanted grooves.

Three-dimensional helical transport is introduced by micropatterned slanted grooves, which are structures often used for chaotic mixing, and the transverse velocity is controlled by the groove geometry. While most literature uses a groove aspect ratio of 1, numerical analysis supports gentle secondary flow introduced by shallow grooves. To demonstrate experimentally that shallow grooves on the floor introduce transverse convection as a subcomponent of the axial flow, a solution of fluorescein and water are injected into the microchannel side by side at a mean axial velocity of 1 mm/s. The main channel width (W) is 500 μm, height (H) is 50 μm, groove width (w) is 50 μm, height (h) is 10 μm, spacing (s) is 50 μm and tilting angle (θ) is 45°. Compared to a channel with smooth floors and operated under the same axial velocity, fluorescein in the groove device shows significant lateral migration from confocal images (FIG. 2). The mean transverse velocity is measured to be ~30 μm/s, matching the prediction from simulation for the selected structure.

Figure 3A:
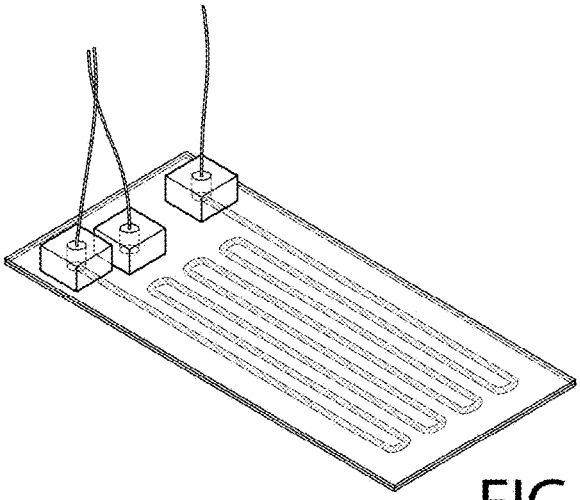
FIG. 3A is a diagram illustrating a schematic showing an assembly of a microfluidic channel device used in the apparatus of an embodiment of the present invention.

FIG. 3A is a diagram illustrating a schematic showing an assembly of a microfluidic channel device used in the apparatus of an embodiment of the present invention.

Figure 3B:
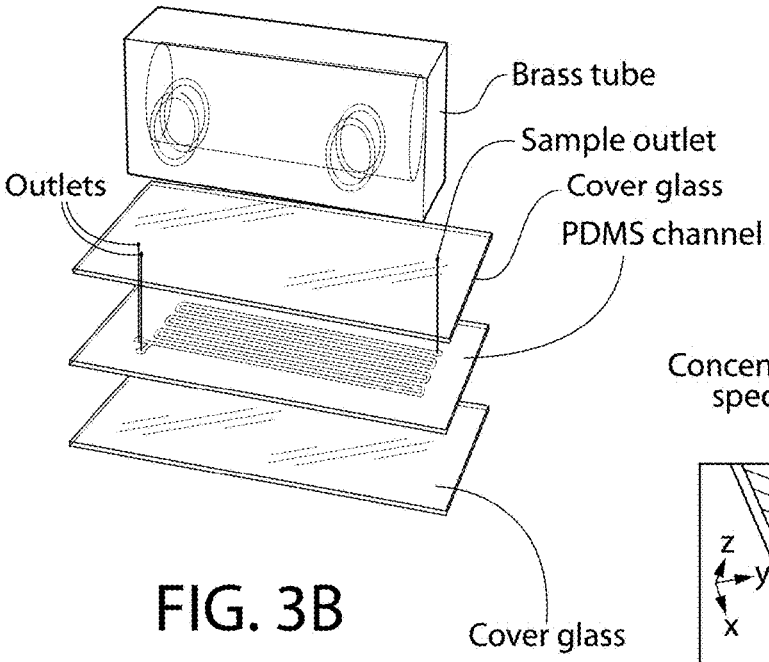
FIG. 3B is an exploded perspective view of a diagram illustrating an apparatus comprising a microfluidic channel device and a brass tube in accordance with one embodiment of the present invention. The brass tube with circulating coolant forms the heat sink while the bottom cover glass was exposed to forced air flow at room temperature, serving as the heat source. The channel dimension was 1 mm×50 μm×30 cm (W×H×L). Groove width was 25 height was tilting angle was 45 degree and spacing was 200 μm.

FIG. 3B is an exploded perspective view of a diagram illustrating an apparatus comprising a microfluidic channel device and a brass tube in accordance with one embodiment of the present invention. The brass tube with circulating coolant forms the heat sink while the bottom cover glass was exposed to forced air flow at room temperature, serving as the heat source. The channel dimension was 1 mm×50 μm×30 cm (W×H×L). Groove width was 25 μm, height was 10 μm, tilting angle was 45 degree and spacing was 200 μm.

Figure 3C:
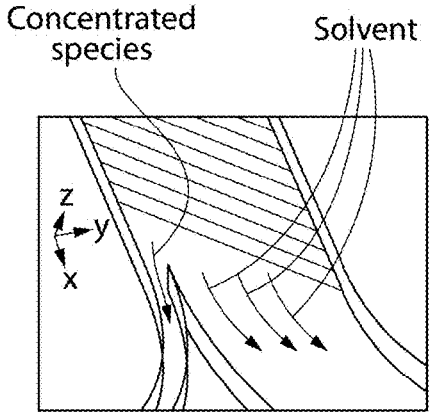
FIG. 3C is a partial, enlarged schematic illustrating a device with inlet and outlet tubing.

FIG. 3C is a partial, enlarged schematic illustrating a device with inlet and outlet tubing.

A temperature gradient is superposed on the helical flow by sandwiching the PDMS thin channel between two coverslips and attaching a cooling pipe to the roof (FIG. 3B). A 50/50 mixture of ethylene glycol and water at a controlled temperature of 273 K to 261 K is circulated in the cooling pipe. The bottom of the assembly is warmed up by air, where room temperature and humidity are controlled at 301 K and 30% respectively.

Figure 4:
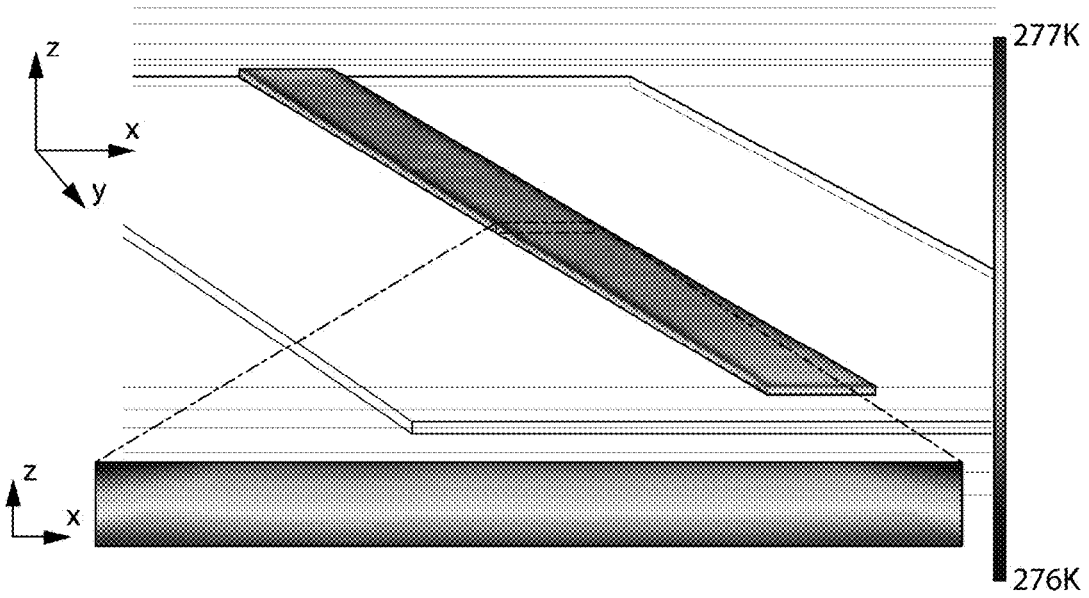
FIG. 4 is a plot/schematic illustrating a temperature gradient in the channel observed by COMSOL simulation. The cooling pipe and room temperature is −12° C. and 28° C., respectively.

FIG. 4 is a plot/schematic illustrating a temperature gradient in the channel observed by COMSOL simulation. The cooling pipe and room temperature is −12° C. and 28° C., respectively. It is found a mild temperature difference of 1 K exists between the ceiling and floor for the temperature difference of −12° C. and 28° C.

Figure 5A:
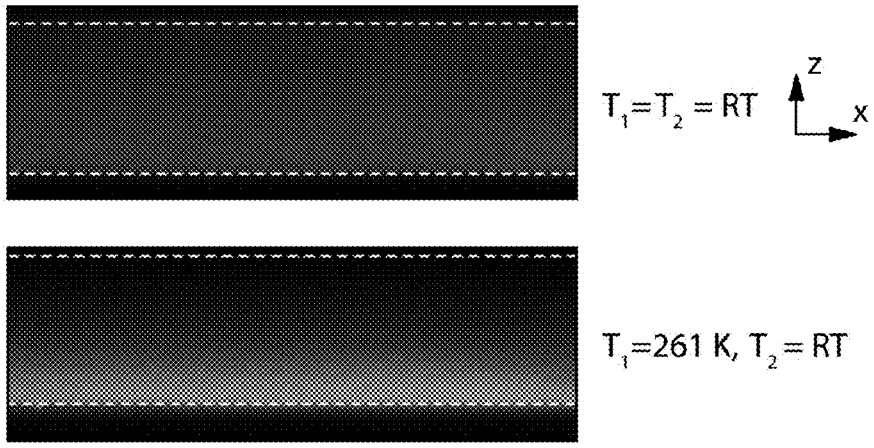
FIG. 5A is a plot (in the top half) illustrating fluorescent intensity in the vertical direction measured by BCECF (2',7'-Bis-(2-Carboxyethyl)-5-(and-6)-Carboxyfluorescein). The top half of FIG. 5A is a plot illustrating 1D fluorescent image of nanoparticles without a temperature gradient. The bottom half of FIG. 5A is a plot illustrating 1D thermophoresis in the channel via a cross-sectional fluorescent image of nanoparticles with a temperature gradient.

FIG. 5A is a plot (in the top half) illustrating 1D thermophoresis in the channel via a cross-sectional fluorescent image of nanoparticles without a temperature gradient. The bottom half of FIG. 5A is a plot illustrating 1D thermophoresis in the channel via a cross-sectional fluorescent image of nanoparticles with a temperature gradient.

Figure 5B:
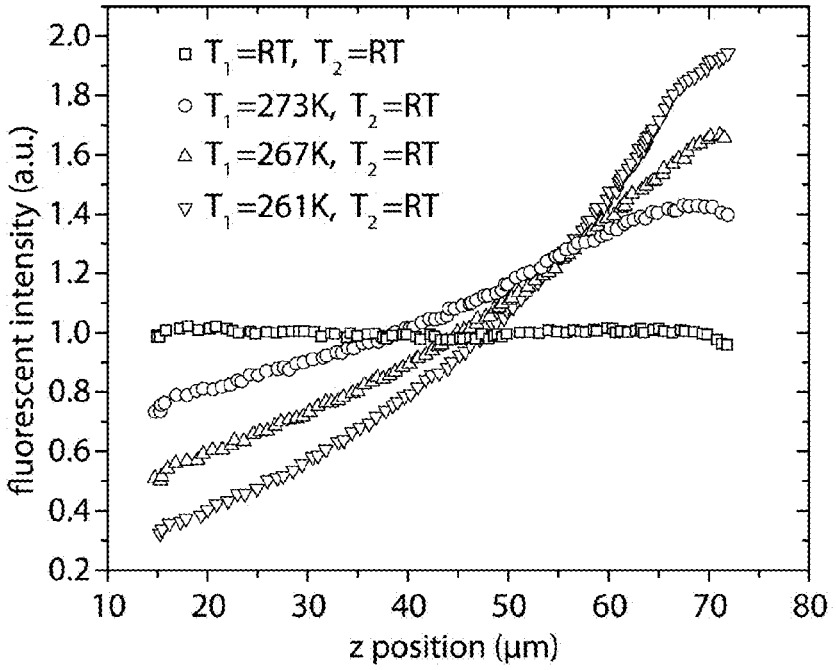
FIG. 5B is a plot illustrating 1D thermophoresis in the channel via a fluorescent intensity profile in z direction for different temperature gradients.

FIG. 5B is a plot illustrating 1D thermophoresis in the channel via a fluorescent intensity profile in z direction for different temperature gradients. Thus, temperature difference is adjustable through coolant of different temperatures.

Under minute temperature gradients of ~0.015 K/μm and without any flow, preferential accumulation of nanoparticles is observed near the floor, and the accumulation becomes more evident when the coolant temperature is reduced from 273 K to 261 K (FIGS. 5*a-b*). Maximum enrichment of 2 is observed when the coolant temperature is 261 K, corresponding to a temperature gradient of 0.02 K/μm. A uniform distribution is observed when the coolant is left to warm to room temperature. Exponential decay of the concentration in the z-direction matches theoretical prediction with a one-dimensional temperature gradient present. Using temperature profiles shown in FIG. 4, the thermophoretic coefficient of 100 nm polystyrene particles is found to be 0.8-1.8 1/K at 273-261 K respectively. As a reference, Soret coefficient of the same particles drop to 0.18 1/K at room temperature from the present inventors' prior measurements. The dramatic increase of Soret coefficients with a decrease of temperature near the water freezing point has been attributed to water hydration entropy. Dampened diffusivity at lower temperature also promote nanoparticle accumulation. Furthermore, lower temperature near 0° C. protects native conformation and function of biological molecules and particles. All these factors support selection of a working temperature near 273 K.

Figure 6A:
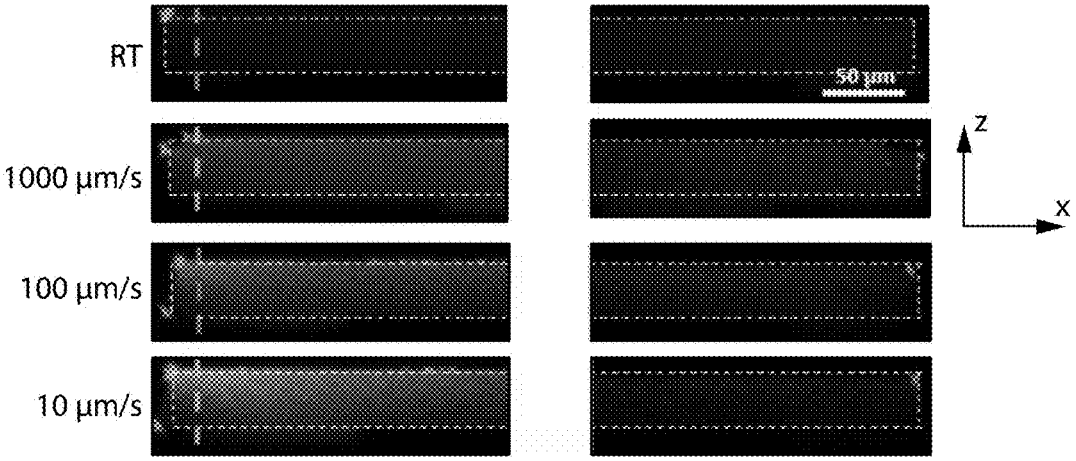
FIG. 6A is a plot illustrating 3D thermophoresis in the channel via a cross-sectional fluorescent image of nanoparticles with a temperature gradient (left side of FIG. 6A) and without a temperature gradient (right side of FIG. 6A), and fluid flow.

FIG. 6A is a plot illustrating 3D thermophoresis in the channel via a cross-sectional fluorescent image of nanoparticles with a temperature gradient (left side of FIG. 6A) and without a temperature gradient (right side of FIG. 6A), and fluid flow.

Figure 6B:
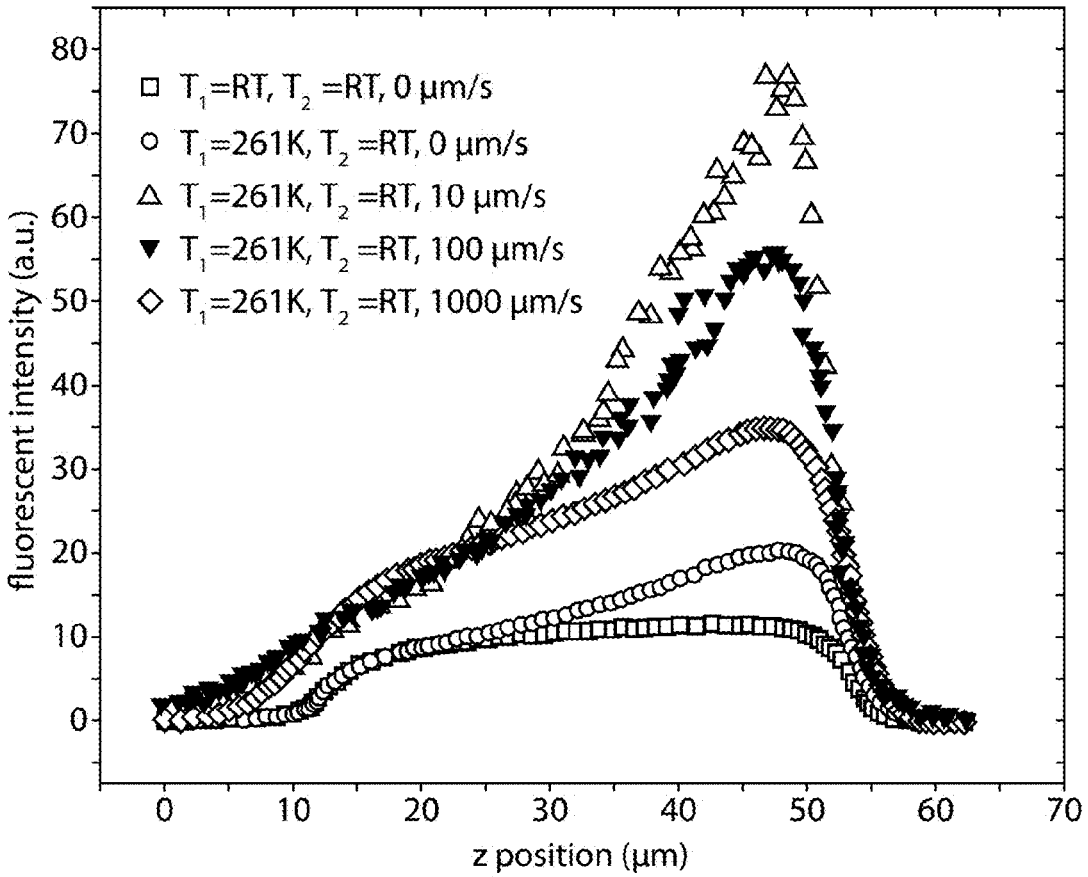
FIG. 6B is a plot illustrating a fluorescent intensity profile in z direction near the device outlet for different temperature gradient and fluid flow.

FIG. 6B is a plot illustrating a fluorescent intensity profile in z direction near the device outlet for different temperature gradient and fluid flow.

Nanoparticle focusing in the lateral direction is achieved by coupling thermophoresis with an engineered helical flow. Swirling in the transverse plane sweeps the concentrated species on the floor to a corner and the concentration factor develops along an axial flow. Steady-state nanoparticle distribution in the x-z planes are shown in FIG. 6A, acquired by fluorescence confocal microscopy. Due to a channel aspect ratio of 1:20, only images from the two sides are shown here. The vertical fluorescent intensity profile was analyzed (FIG. 6B). At room temperature, the fluorescent intensity is uniform and low (FIG. 6B). With fluid flow and temperature gradient, nanoparticles are focused to the bottom left part of the cross section of the channel. The focusing effect is dependent on the axial flow. As shown in FIG. 6B, an axial flow of 10 μm/s yields the highest concentration factor of ~10, calculated by comparing the intensity with a calibration curve.

To interpret the dependence of concentration factors on the axial flow rate, transport processes in the microchannel are inspected more carefully through numerical analysis. Swirling and thermophoretic fluxes are calculated for each of the flow conditions: the swirling flux is calculated by averaging the positive secondary flow flux in a period, and the thermophoretic flux is the product of thermophoretic velocity and cross sectional area. When the concentration factor is plotted against the ratio of the two fluxes, maximum concentration is observed for a ratio of 1 (FIG. 14A), which is analogous to resonance frequency. Alternatively, the flux ratios are controlled by device geometry, which is still under investigation.

Focusing nanoparticles by ultracentrifugation has a history of more than a century. In this study, a novel method to focus nanoparticles by coupling thermophoresis and artificial lateral flow in microfluidics, which is continuous and label-free, is more advanced than conventional centrifuge. Quantitative analysis reveals the governing competing factors, microfabrication implements the design and assembled devices proves the idea. The present invention is a promising tool which can potentially substitute the centrifuge in every lab.

Additional Exemplary Embodiments

Inspired by the operation principle of the thermal diffusion column, the inventors have recently designed a microfluidic device that couples a simple, one-dimensional temperature gradient with an engineered helical fluid motion to achieve nanoparticle enrichment in a continuous flow. In the transverse plane of the channel, the combined swirling motion and thermophoresis mimic the transport in a thermal diffusion column, so nanoparticles are gradually focused to one corner. The focusing effect develops along the axial flow until a steady state is reached. The concentrated species can be retrieved continuously from a strategically positioned outlet, opposed to batch processing in a thermal diffusion column. Another benefit of the design is to control thermophoresis and swirling flow separately, which allow physical understanding and optimization of the enrichment process. Since thermal migration is intrinsic to all solvated species, no labeling is required and particles remain suspended in the focusing process. This avoids aggregation associated with pelleting in centrifugation and caking in ultrafiltration, both of which contributes to variable yields.

Helical fluid motion in a laminar flow have been generated by physical structures in microchannels or side-by-side flow of density mismatched solutions. Slanted parallel grooves patterned on the microchannel floor have been chosen in this study due to its ability to generate stable transverse recirculation at a low Reynolds number. While slanted or staggered herringbone grooves are usually used for passive mixing in microchannels, magnitude and pattern of the transverse swirling are controllable and predictable, allowing their applications for demixing nanoparticles. To understand how nanoparticle focusing is influenced by the device design and flow condition, the inventors performed numerical analysis using a finite element method and continuous phase model. A dimensionless analysis was also carried out to relate the concentration factor with the velocities of transverse circulation and thermophoresis, which provides insights about physical processes governing nanoparticle focusing.

Mathematical Model and Numerical Method:

Steady state simulations were performed by employing a continuous phase model. The equations governing the fluid motion are conservation of mass and momentum:

$$\nabla \cdot (\rho u) = 0 \tag{1}$$

$$u \cdot \nabla u = -\frac{1}{\rho}\nabla p + \gamma \nabla^2 u + \alpha g(T - T_0) \tag{2}$$

where ρ is fluid density, γ is kinematic viscosity, u is fluid velocity, p is pressure, α is the thermal expansion coefficient of the fluid, g is gravitational acceleration, $T_0$ is the reference temperature for which the fluid density is evaluated and T is the temperature. The Boussinesq approximation is employed to model natural convection, as illustrated in equation (2).

The conservation of energy yields:

$$\rho C_p u \cdot \nabla T = \nabla \cdot (k \nabla T) \tag{3}$$

where $C_p$ is heat capacity of the fluid and k is thermal conductivity of the fluid.

Mass transport equation including diffusion, advection and the thermophoretic flux is given by:

$$\nabla \cdot (D_T c \nabla T + D \nabla c) - \nabla \cdot (uc) = 0 \tag{4}$$

where c is the concentration of the species, $D_T$ is the thermophoretic coefficient, and D is the diffusion coefficient. Walls are treated as no-slip and no-penetration boundary, and the temperature are fixed on the surfaces of the channel.

The continuous phase model was implemented using COMSOL. The Transport of Species Model was modified to include the thermophoretic flux term $D_T c \nabla T$ and solved together with conservation of mass, momentum and energy (equations 1-3). The channel was designed to have grooves on the floor, and a temperature difference of 10 K was established by setting temperatures on the top and bottom walls of the main channel at 293 and 303 K, respectively. The temperature gradient is low enough that natural convection caused by density mismatch is negligible and engineered circulatory motion introduced by the grooves dominates in the transverse plane. This was confirmed by separately inspecting recirculation velocity from natural and engineered convection in the simulation. Parameters corresponding to 100 nm polystyrene particles in water were used: the diffusion coefficient 4.4 $\mu m^2/s$, and the Soret coefficient 0.18/K. Physical properties of water are: the viscosity of water 0.001 Pa·s, the density 1000 $kg/m^3$, the heat capacity 4.2 J/g·K, and the thermal conductivity 0.6 W/m·K. The magnitude of the gravitational acceleration is set at 9.8 $m/s^2$. The concentration factor was calculated by normalizing the greatest concentration at a cross-section or at the steady state to the initial uniform concentration. The focusing effect was confirmed to be independent of the mesh element number for each of the test conditions.

Figure 7:
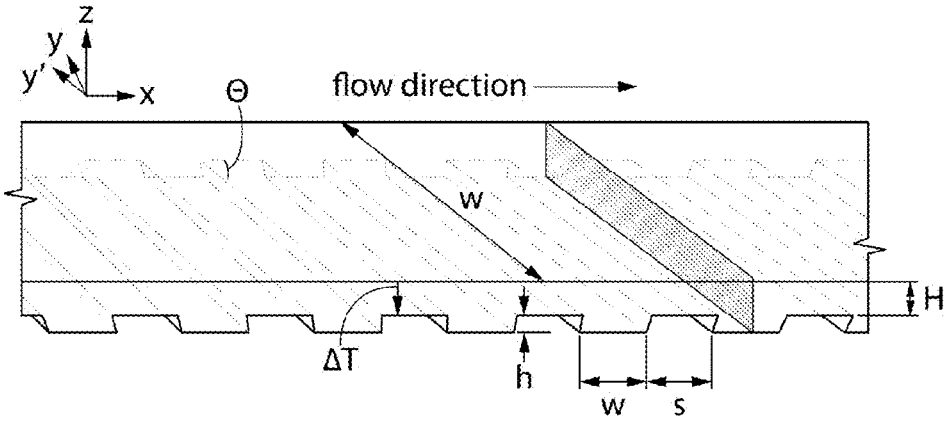
FIG. 7 is a schematic illustrating a section of the microchannel with slanted grooves at the bottom. Geometrical parameters studied in this study includes microgroove tilting angle (θ), depth (h), spacing (s), and main channel width (W). The angle between –y' axis and axis x is θ. The shaded box in the channel indicates a sample surface where average transverse velocity was obtained.

Results:

FIG. 7 is a schematic illustrating a section of the microchannel with slanted grooves at the bottom. Geometrical parameters studied in this study includes microgroove tilting angle (θ), depth (h), spacing (s), and main channel width (W). The angle between –y' axis and axis x is θ. The shaded box in the channel indicates a sample surface where average transverse velocity was obtained.

TABLE 1

Channel geometry and streamwise component of velocity used in the simulation

| Parameters | Default Values | Tested Range |
|---|---|---|
| Streamwise velocity ($v_x$) | 24 μm/s | 0.5 μm/s-24 μm/s |
| Groove tilting angle (θ) | 45° | 27°-64° |
| Groove height (h) | 50 μm | 10 μm-60 μm |
| Groove spacing (s) | 50 μm | 50 μm-350 μm |
| Groove width (w) | 50 μm | constant |
| Main channel width (W) | 1000 μm | 500 μm-2000 μm |
| Soret coefficient ($S_t$) | 0.18 l/k | 0.045 1/K-0.72 l/K |

A detailed structure of the slanted microgroove design is shown schematically in FIG. 7. Geometrical parameters investigated in this study include: main channel width (W), main channel height (H), groove width (w), groove height (h), groove spacing (s), groove angle (θ). The average streamwise velocity (vx) in the main channel is also studied (Table 1).

Figure 8A:
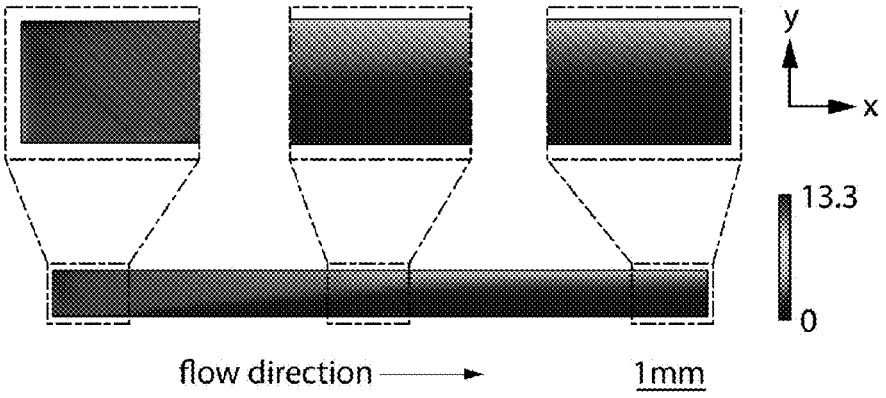
FIG. 8A is a plot/schematic illustrating a concentration profile observed from the top (x-y plane) in the microgrooved devices with a temperature gradient.

FIG. 8A is a plot/schematic illustrating a concentration profile observed from the top (x-y plane) in the microgrooved devices with a temperature gradient.

Figure 8B:
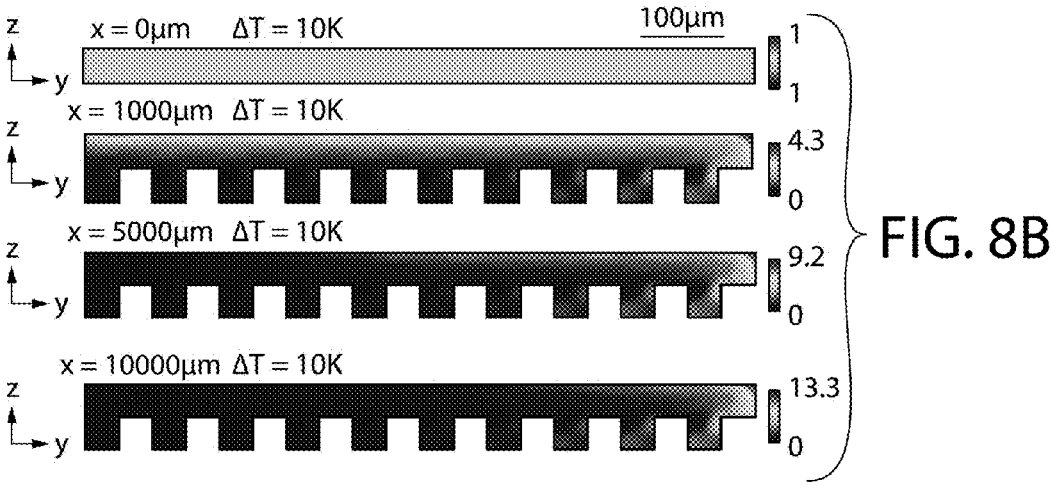
FIG. 8B is a plot/schematic illustrating a concentration redistribution of nanoparticles observed at cross-sections (y-z plane) of different distances from the inlet.

FIG. 8B is a plot/schematic illustrating a concentration redistribution of nanoparticles observed at cross-sections (y-z plane) of different distances from the inlet.

Figure 8C:
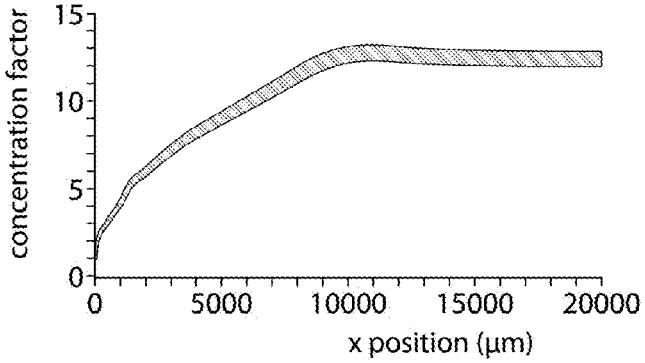
FIG. 8C is a plot illustrating a development of the concentration factor along the streamwise (x) direction.

FIG. 8C is a plot illustrating a development of the concentration factor along the streamwise (x) direction.

Figure 8D:
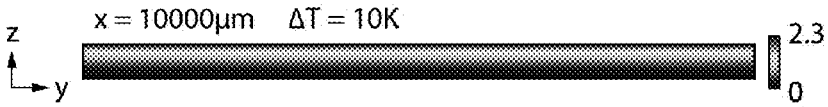
FIG. 8D is a plot/schematic illustrating a cross-section (y-z plane) of a flatbed channel showing 1D redistribution of nanoparticles from thermophoresis alone.

FIG. 8D is a plot/schematic illustrating a cross-section (y-z plane) of a flatbed channel showing 1D redistribution of nanoparticles from thermophoresis alone.

Figure 8E:
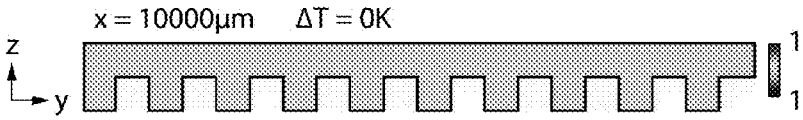
FIG. 8E is a plot/schematic illustrating a cross-section of a microgrooved channel demonstrating uniform nanoparticle distribution in the absence of a temperature gradient.

FIG. 8E is a plot/schematic illustrating a cross-section of a microgrooved channel demonstrating uniform nanoparticle distribution in the absence of a temperature gradient.

FIGS. 8A-8E show one example of nanoparticle redistribution in a microchannel with H=50 W=1000 μm, w=50 μm, h=50 μm, s=50 μm, vx=12 μm/s, θ=45° and ΔT of 10 K between the main channel floor and ceiling. As seen from the concentration profiles in the x-y plane (FIG. 8A, top view) and in y-z planes of different distances from the inlet (FIG. 8B, cross-sectional view), nanoparticles are uniformly distributed at the inlet, and gradually concentrate to one corner. The concentration at the top right corner (observed from the outlet) develops along the streamwise direction and reaches maximum within 15 mm from the inlet (FIG. 8C). To verify that the enrichment is a combined result of engineered swirling motion and thermophoresis, the inventors further analyzed two control cases in the simulation: (1) the microchannel contained no grooves, while the flow rate and temperature gradient were the same as describe above (FIG. 8D) and (2) the same geometry and flow rate were used as in FIG. 8A, but the temperature was uniform of 293 K (FIG. 8E). In the first case, thermophoresis introduces a vertical migration of nanoparticles to the ceiling, and the largest concentration, consistent along the device ceiling, is ~2 times the initial uniform concentration. In the second case, the nanoparticle concentration remains uniform in every cross section and no enrichment is observed. Additionally, nanoparticle distribution was analyzed in a flat section beyond the grooved section and species concentrated in the corner quickly diffuses to a one-dimensional distribution as in FIG. 8D, demonstrating the importance of coupled recirculation and thermophoresis.

Figure 9A:
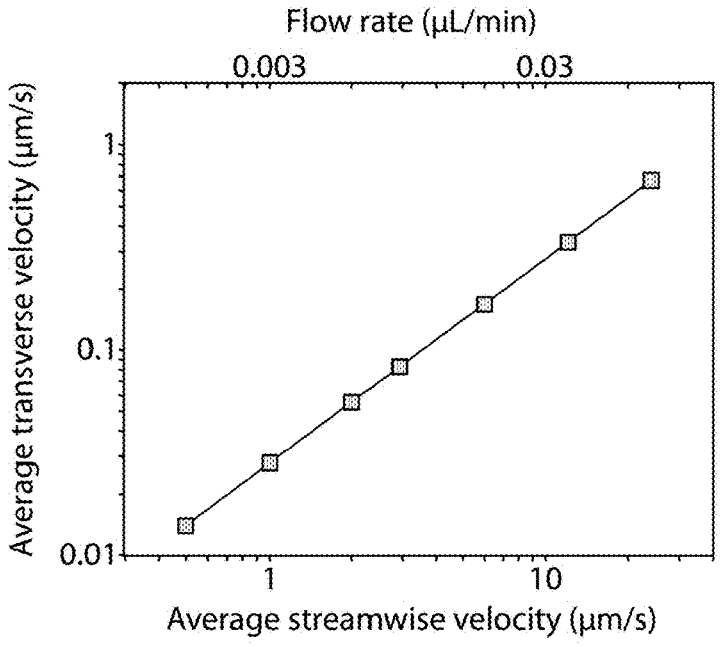
FIG. 9A is a plot illustrating a relationship between the average streamwise and transverse velocities.

FIG. 9A is a plot illustrating a relationship between the average streamwise and transverse velocities.

Figure 9B:
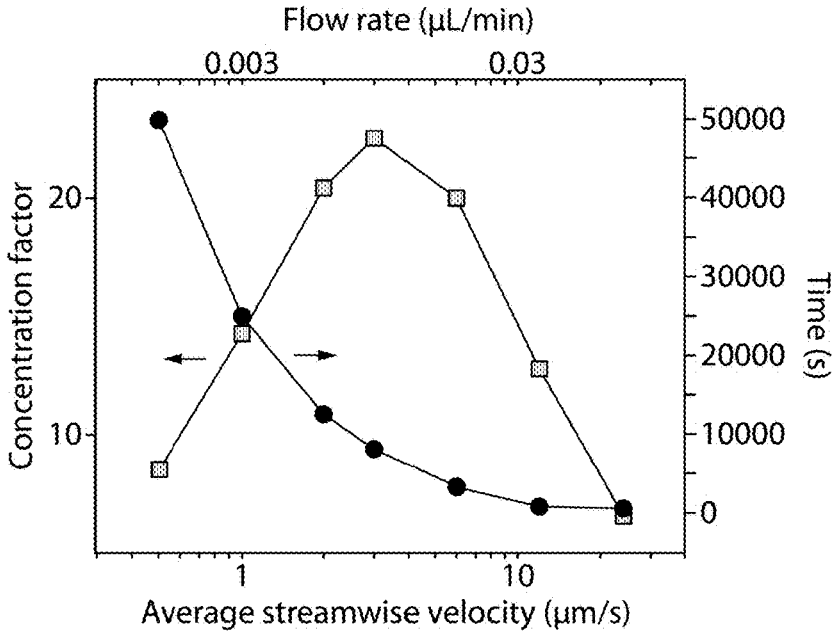
FIG. 9B is a plot illustrating a relationship between the concentration factor/migration time and average streamwise velocity.

FIG. 9B is a plot illustrating a relationship between the concentration factor/migration time and average streamwise velocity.

Figure 9C:
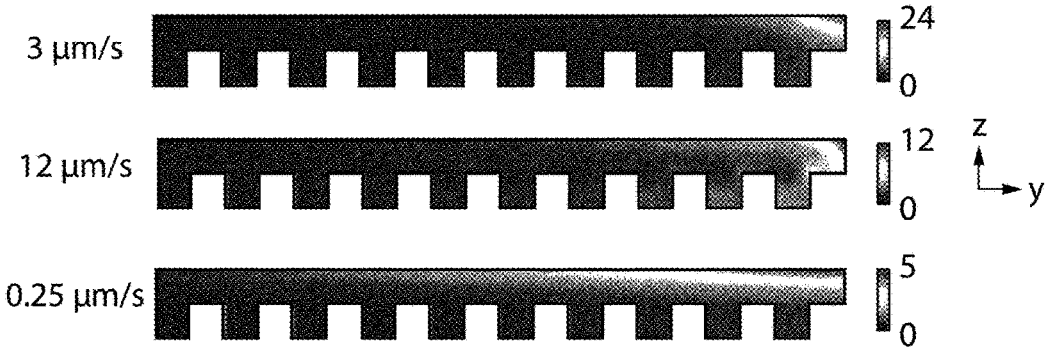
FIG. 9C is a plot/schematic illustrating a cross-sectional (y-z plane) concentration profile under three average inlet velocities, showing the critical or the optimal (top) and suboptimal (middle and bottom) nanoparticle distribution at the steady state.

FIG. 9C is a plot/schematic illustrating a cross-sectional (y-z plane) concentration profile under three average inlet velocities, showing the critical or the optimal (top) and suboptimal (middle and bottom) nanoparticle distribution at the steady state.

Independent control of thermophoresis (through the temperature gradient) and transverse recirculation (through the microgroove geometry and flow rate) allows fundamental studies of how different transport processes interplay to promote nanoparticle accumulation. First, the inventors studied the influence of the transverse velocity, which was quantified by the average magnitude of vy in the center plane of one groove (shaded box in FIG. 7). Since the transverse component of the helical motion is a secondary flow, the inventors varied the magnitude of primary flow in the range of 0.5-24 μm/s to manipulate the magnitude of the transverse velocity. The device geometry followed the default values in Table 1. FIG. 3*a* demonstrates a linear relationship between the average streamwise (vx) and transverse (vy) components of velocities, and the latter is determined to be in the range of 0.014-0.67 μm/s (FIG. 9A). As observed in FIG. 9B, the concentration factor spans a range of 2-25 at the steady state. A peak concentration is reached at the critical (optimal) streamwise velocity of 3 μm/s, and the concentrated species is tightly bound in one corner (FIG. 9C, top). At higher flow rates, the accumulation zone stretches in the z-direction, indicating that the transverse recirculation sweeps significant amount of concentrated particles from the corner back into the channel (FIG. 9C, middle). When the average streamwise velocity is below the critical value, the nanoparticles distribute broadly along the ceiling, due to weak swirling that is inefficient to overcome diffusion and to sweep particles to the corner (FIG. 9C, bottom).

The migration time scale, calculated by dividing the initial x position of the concentration plateau in the enrichment corner by the average streamwise velocity, is found to increases monotonically in the range of flow rates tested here. Such a relationship can be explained by analyzing the characteristic transport times. Given the temperature gradient and Soret coefficient used here, the thermal diffusion velocity is ~0.16 μm/s, and the characteristic time for thermophoretic transport in the z direction is ~5 min. On the other hand, the average transverse velocity is in the range of 0.014-0.67 μm/s, and the characteristic time for convective transport along the ceiling is on the order of 10-1000 min. Thus transverse sweeping is the limiting process in all cases; the characteristic migration time scales inversely with the transverse or streamwise velocities.

The inventors further compared the performance of the microfluidic device with a thermal diffusion column. A column with an inversed aspect ratio (to allow natural convection) and the same temperature gradient yields a steady state concentration factor of only 4.78, and the average swirling velocity is 1.25 μm/s (data not shown). At such an average transverse velocity, the streamwise velocity is 45 μm/s. The microfluidic device operates on the right side of the enrichment peak and reaches a similar concentration factor at the steady state. This indicates comparable focusing mechanisms in the transverse planes in these two devices. In contrast to the thermal diffusion column, the microfluidic device allows control of the transverse velocity independent of the temperature gradient. Such control is the key to continuous sample processing and optimization of the accumulation effect, as described below.

Since the above analysis suggests a significant role of the transverse velocity, which is controllable by the geometry of the slanted grooves, the inventors next fixed the average streamwise velocity (vx) to be 24 μm/s and varied the device geometrical parameters to study how they affect the concentration factor. The oblique angle, depth and groove spacing were varied one at a time, while the other parameters were held at the default values as shown in Table 1.

Figure 10A:
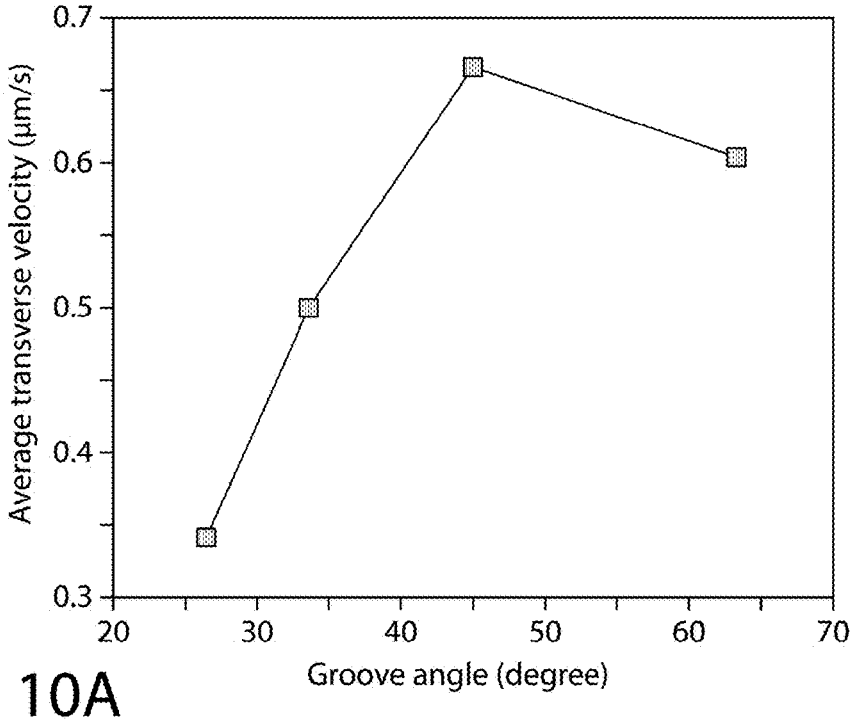
FIG. 10A is a plot/schematic illustrating a relationship between the average transverse velocity and groove angle.

FIG. 10A is a plot/schematic illustrating a relationship between the average transverse velocity and groove angle.

Figure 10B:
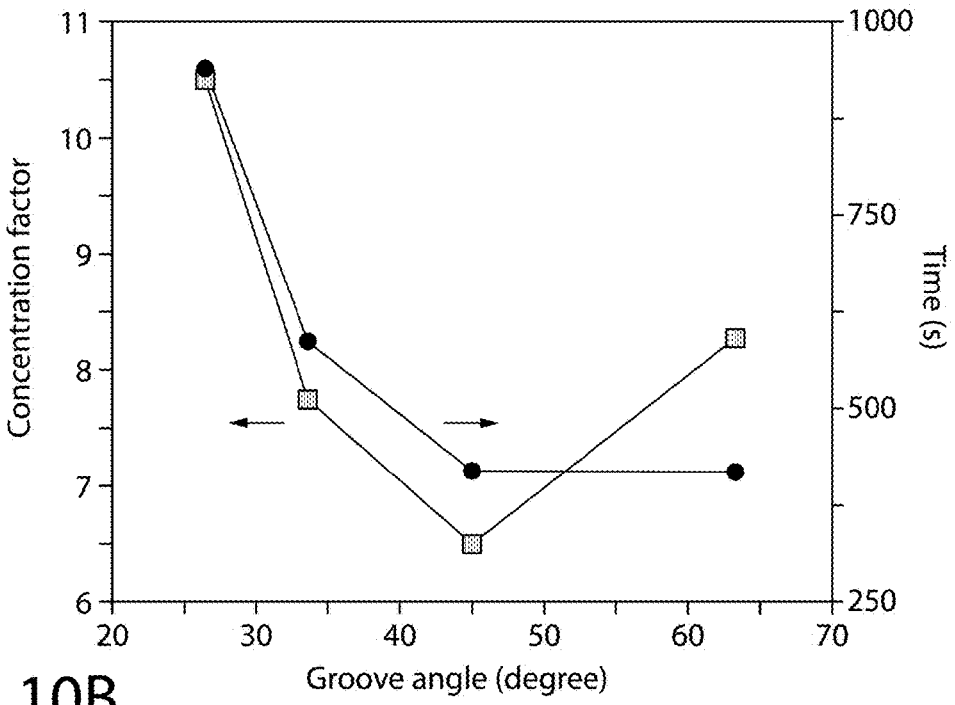
FIG. 10B is a plot/schematic illustrating a relationship between the concentration factor/migration time and groove angle.

FIG. 10B is a plot/schematic illustrating a relationship between the concentration factor/migration time and groove angle.

The first parameter studied, the groove angle (θ), was tested between 27° and 64°. FIG. 10A shows that the average transverse velocity peaks at around 45°. The concentration factor, on the other hand, has a minimum of 6.5 when the angle is 45°. As shown in FIG. 9B, the sweeping is too strong to promote optimal accumulation at vx=24 μm/s and θ=45°. When the angle deviates from 45°, milder sweeping enhances accumulation, but extends the migration time. Since the concentration factor is expected to drop to 2 when the groove angle is 0 or 90°, driven by thermophoresis alone, peak concentration factors may exist for groove angles in the range of 0°-27° and 64°-90°. However, angles lower than 27° or greater than 64° were not simulated due to unmanageable meshing that is necessary to attain spatial convergence. Experimentally, grooves with a low angle relative to the axis are difficult to fabricate without defects, thus are less practical to control the accumulation effect than some other parameters discussed later.

Figure 11A:
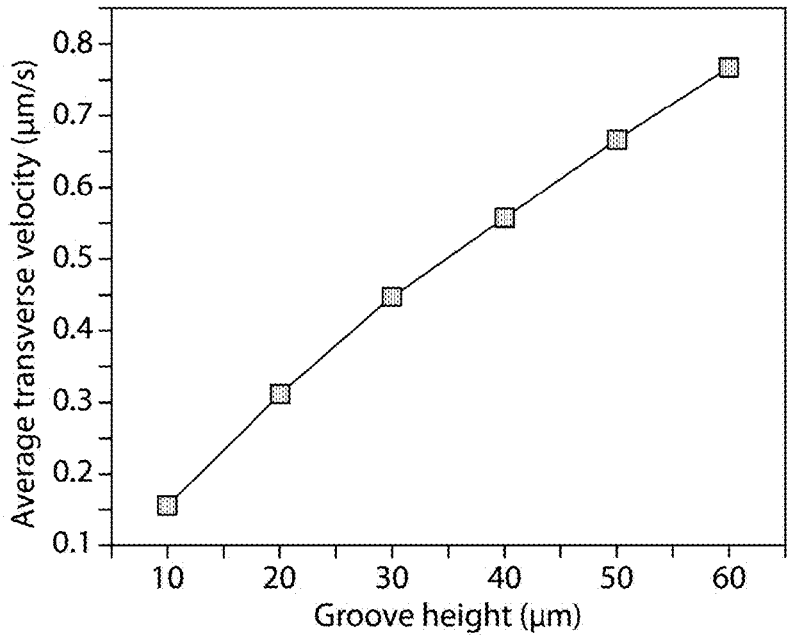
FIG. 11A is a plot illustrating a relationship between the average transverse velocity and groove height.

FIG. 11A is a plot illustrating a relationship between the average transverse velocity and groove height.

Figure 11B:
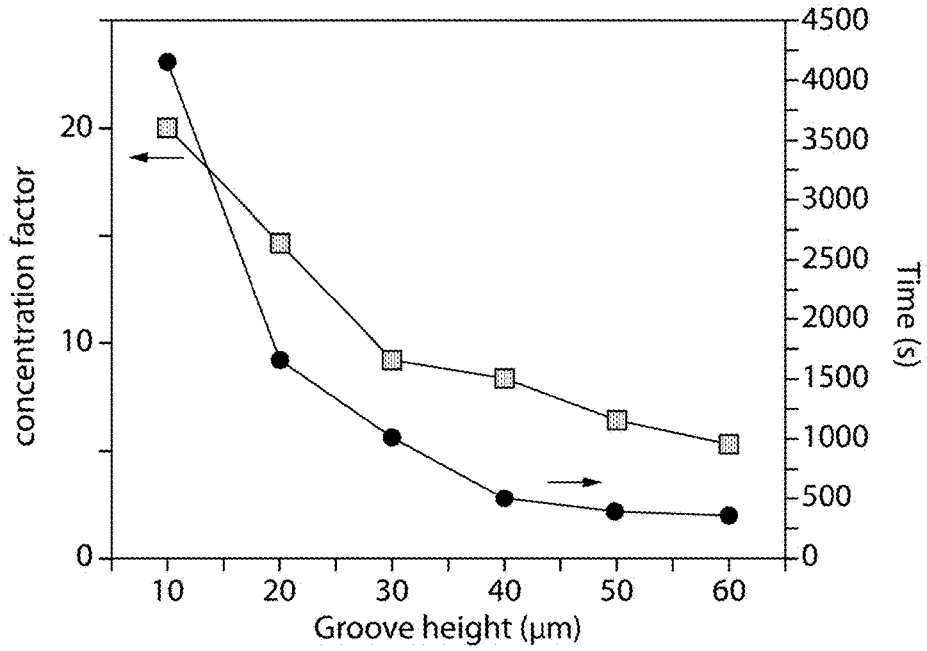
FIG. 11B is a plot illustrating a relationship between the concentration factor/migration time and groove height.

FIG. 11B is a plot illustrating a relationship between the concentration factor/migration time and groove height.

Next, the groove height (h) was studied with all other parameters at the default values. When the groove height is zero, the channel has a flat floor and there is no helical fluid motion. The average sweeping velocity strengthens with the groove height in the range of 10-60 μm (FIG. 11A). On the other hand, the concentration factor decreases with increasing groove height, i.e. accumulation is dampened when the vortex is more intense. Quantitatively, the concentration factor increases from 5 to 20 as the groove height drops from 60 μm to 10 μm (FIG. 11B). At a groove height of 0, the concentration factor is expected to drop to about 2 from thermophoresis alone, thus a peak accumulation may occur with a groove height between 0 and 10 However, excessive meshing for grooves shallower than 10 μm made it difficult to simulate the focusing effect. Yet, compared to the groove angle discussed above, shallower grooves are easier to fabricate and thus is a more practical parameter for optimizing the concentration factor.

Figure 12A:
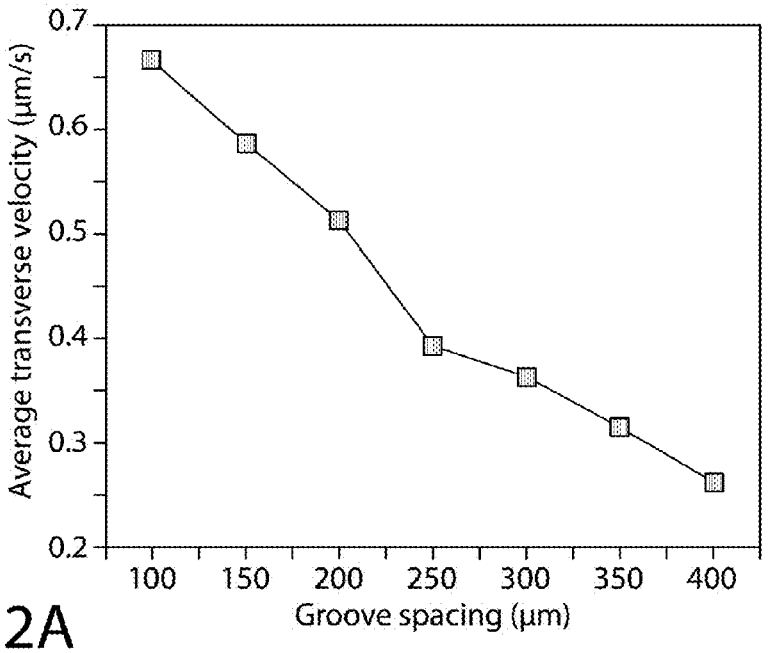
FIG. 12A is a plot illustrating a relationship between the average transverse velocity and groove spacing.

FIG. 12A is a plot illustrating a relationship between the average transverse velocity and groove spacing.

Figure 12B:
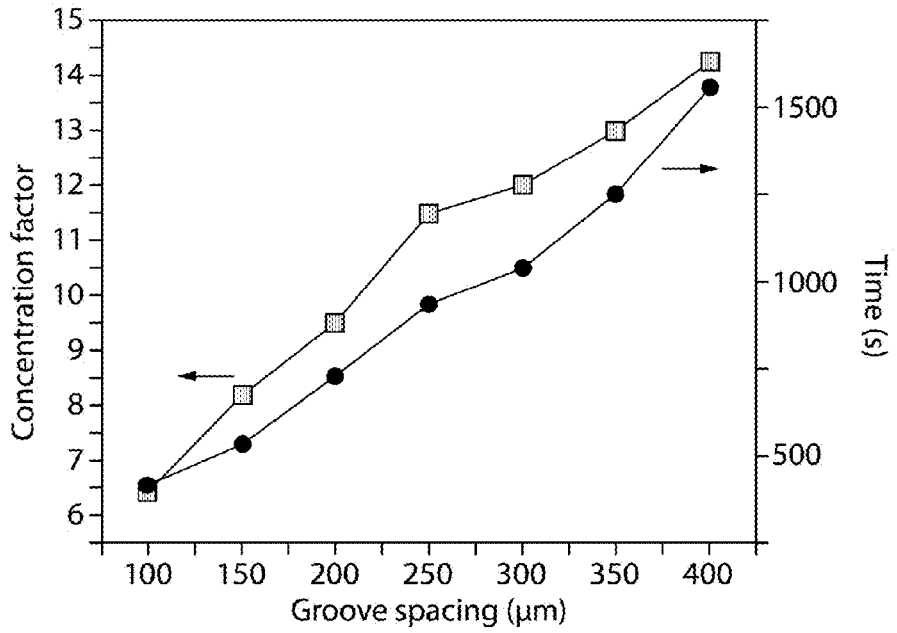
FIG. 12B is a plot illustrating a relationship between the concentration factor/migration time and groove spacing.

FIG. 12B is a plot illustrating a relationship between the concentration factor/migration time and groove spacing.

The third parameter investigated is the spacing (s) between the grooves, with the groove width, depth and angle being fixed as in Table 1. As the spacing expends from 100 μm to 400 μm the sweeping velocity is continuously reduced (FIG. 12A), while the concentration factor increases from 6.5 to 14.2 (FIG. 12B). When the spacing is greater than 400 the vortical motion is no longer continuous and nanoparticles diffuse away from the corner between vortices. On the other hand, when the spacing is zero, no vortex exists and the concentration factor drops to about 2, driven by thermophoresis alone. The migration time is mostly controlled by the sweeping velocity, which is dampened by more separated grooves. Thus the migration time continuously increases with the spacing.

Figure 13A:
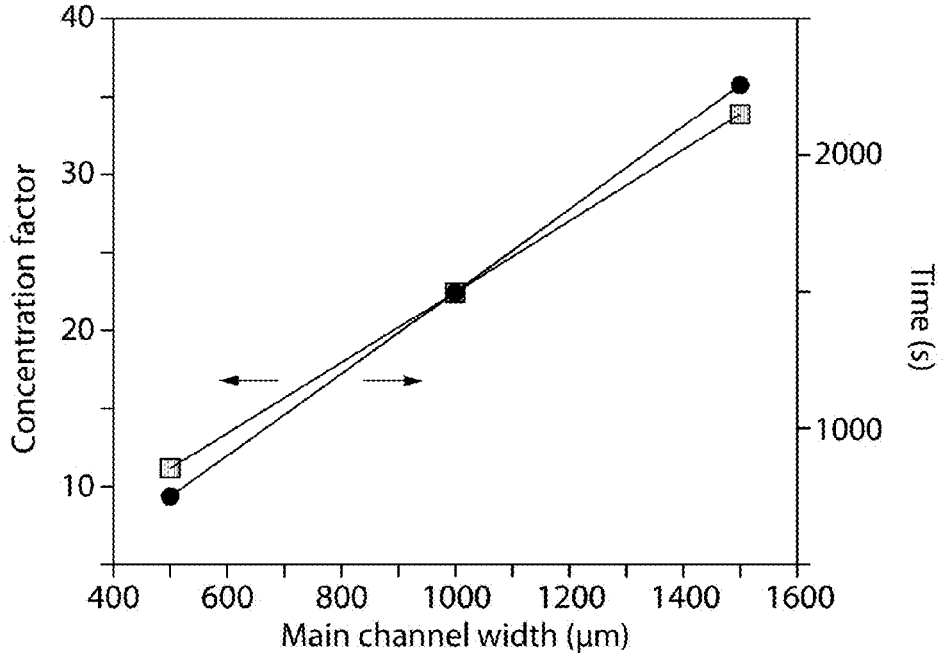
FIG. 13A is a plot illustrating a relationship between the concentration factor/migration time and aspect ratio of the main channel.

FIG. 13A is a plot illustrating a relationship between the concentration factor/migration time and aspect ratio of the main channel.

Figure 13B:
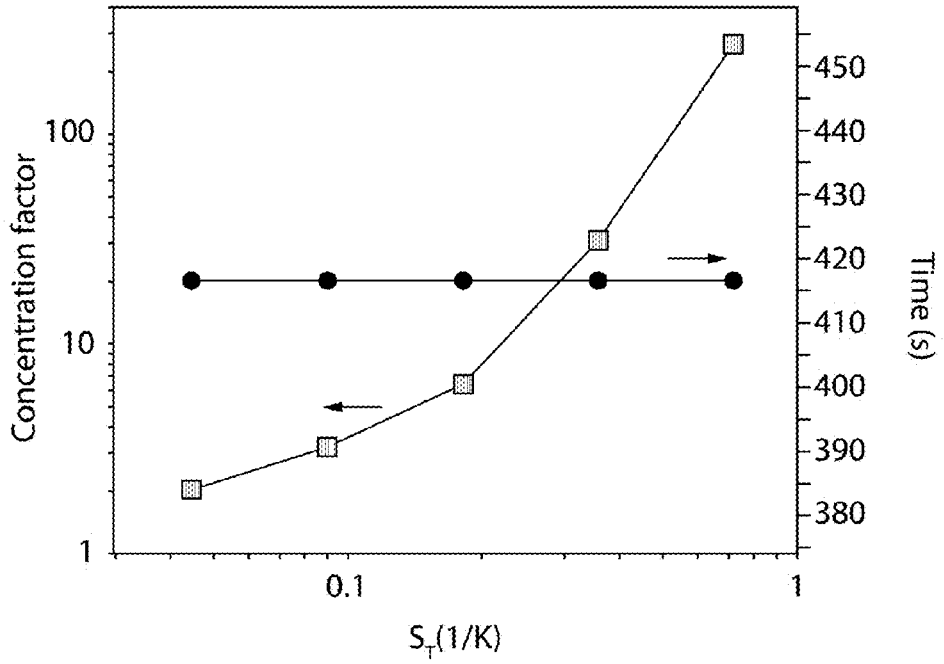
FIG. 13B is a plot illustrating a relationship between the concentration factor/migration time and $S_T$.

FIG. 13B is a plot illustrating a relationship between the concentration factor/migration time and $S_T$.

In addition to the groove geometry, main channel geometry (W) was also analyzed (FIG. 13A). The channel thickness was held constant to maintain a constant temperature gradient, and the width was varied from 500 μm to 1500 μm, leading to aspect ratios of 1/10-1/30. As the channel widens, the input flow rate increases proportionally under a constant mean streamwise velocity of 3 μm/s, leading to greater amount of nanoparticle feed. The sweeping velocity, controlled by the streamwise velocity and groove geometry, remains constant. As a result, the concentration factor and the migration time both increase linearly with the channel width.

Serving the driving force for the concentration effect, the Soret coefficient (ST) was last examined with the default geometry in Table 1. Debye's theory predicts that concentration in a thermal diffusion column improves exponentially with the product of Soret coefficient and temperature gradient. This relationship is observed in the present inventors' device (FIG. 13B), indicating comparable physical processes. The migration time remains constant as a result of transverse transport being the limiting process and independent of the Soret coefficient.

Figure 14A:
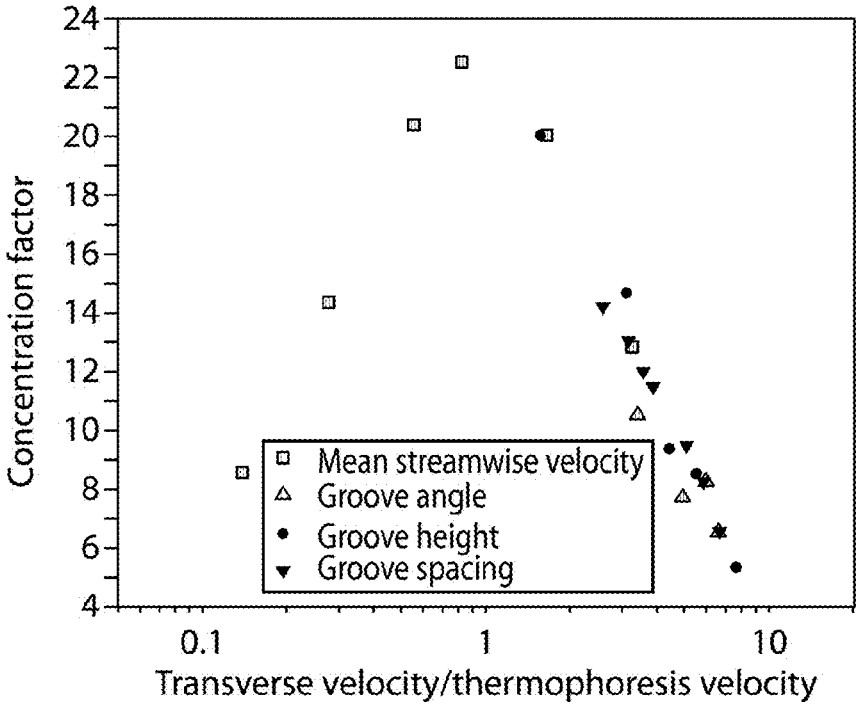
FIG. 14A is a plot illustrating a relationship between the concentration factor and ratio between transverse velocity and thermophoretic velocity.

FIG. 14A is a plot illustrating a relationship between the concentration factor and ratio between transverse velocity and thermophoretic velocity.

Figure 14B:
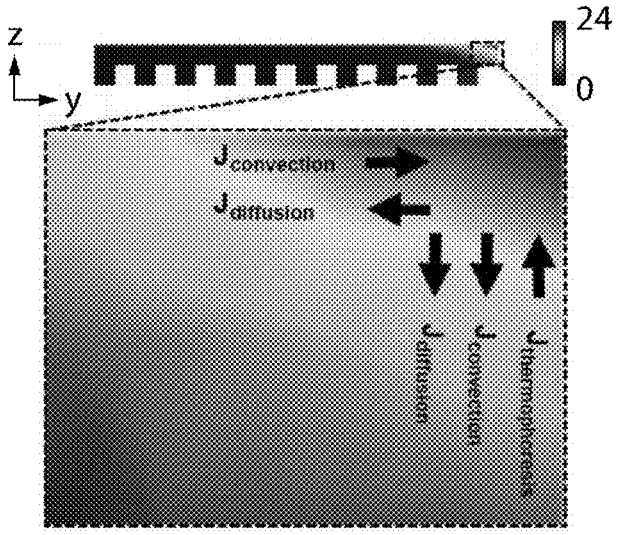
FIG. 14B is a plot/schematic illustrating different transport processes at the enrichment corner. The upper diagram shows a cross-sectional (y-z plane) concentration profile and the lower zoomed-in diagram shows the different fluxes near the corner with the greatest accumulation.

FIG. 14B is a plot/schematic illustrating different transport processes at the enrichment corner. The upper diagram shows a cross-sectional (y-z plane) concentration profile and the lower zoomed-in diagram shows the different fluxes near the corner with the greatest accumulation.

Since the focusing effect strongly depends on the swirling, data from FIGS. 9A-12B were re-analyzed with respect to the mean transverse velocity (vy). The thermophoretic transport is comparable in these cases. Interestingly, data from various geometrical and flow conditions fall reasonable well on one master curve (FIG. 14A). Among all the parameters, the streamwise velocity generates the widest range of transverse velocities, and is the most effective for controlling the concentration factor. The groove spacing and depth are attractive since they can be optimized without sacrificing the sample throughput or adding to fabrication complexity.

The average transverse velocity is further normalized by the thermophoretic velocity, and the peak concentration factor occurs when the ratio is near unity (FIG. 14A). This relationship can be appreciated qualitatively by considering transport at the accumulation corner, where at the steady state, thermophoretic flux, diffusive and convective flux reaches a dynamic balance (FIG. 14B). When the transverse velocity is much greater than thermophoretic velocity, net flux in the z-direction is not optimal. On the other hand, when the transverse velocity is weak, optimal net flux in the y-direction is not reached. The strong dependence of enrichment on mass transport emphasizes the significance of independently controlling the transport processes.

The universal thermophoretic behavior of nanoparticles and molecules in solutions make this microfluidic approach widely applicable. $D_T$ and $S_T$ (where $D_T$ is the thermal diffusion coefficient and $S_T$ is the Soret coefficient) of various solid particles and synthetic vesicles have been measured as a function of particle and solution properties. Most studies report a rather narrow range of $D_T$ from $10^{-9}$ to $10^{-8}$ $cm^2$ $s^{-1}$ $K^{-1}$ for micelles, polymers and polystyrene spheres in water up to a diameter of 250 nm, compared to the diffusivity D spanning more than two orders of magnitude. This weak dependence of $D_T$ on size drastically differs from mobility induced by dielectrophoresis, magnetophoresis, centrifugation and optical trapping, where the mobility scales with the second or third power of the particle radius, and becomes insignificant on the nanoscale. Thus, thermophoretic force is strong enough to manipulate the motion of molecules and nanoparticles, and to enrich nano-species.

In fact, thermophoresis has been combined with convection in various ways for molecular and nanoparticle separation. For example, thermal field flow fractionation relies on the balance between thermophoresis and diffusion to sort molecules and particles into different streams in a parabolic velocity profile. It has been commercially adopted for composition analysis of polymers and colloids. The other commonly employed thermophoretic device, the thermal diffusion column, uses a temperature gradient to drive both the thermal migration and convective recirculation, leading to analyte enrichment in a corner. Albeit effective, both types of devices employ the batch process and don't allow continuous processing: thermal field flow fractionation requires a plug sample to prevent different species from overlapping in the streamwise direction; a thermal diffusion column is usually a closed capillary to promote recirculation. Recently, a modified thermal diffusion column allowed for a continuous feed and periodic sample retrieval. However, the pressure driven flow has to be slow enough to preserve the natural convection roll. This design does not address the issue of separately control the transport processes either, thus it faces the similar challenge of performance optimization as in a conventional thermal diffusion column. A moving laser was used to separately drive convection and thermophoresis, while the strategy is difficult to scale up. Compared to these attempts, the microfluidic approach presented here offers significant advantage of continuous sample processing and scalability. In addition, independently controlled transport processes make it easy to optimize and predict the device performance, both in terms of the concentration factor and processing throughput.

In conclusion, the present inventors' simulation demonstrates the feasibility to focus nanoparticles in a microfluidic channel through coupled thermophoresis and swirling transport induced by grooves over the surface. The migration time scale is controllable by the two active transport mechanisms, and the dimensional analysis reveals matched fluxes produce optimal focusing effect. The computational analyses will guide design of microfluidic devices to achieve nanoparticle focusing in a label-free and continuous flow process.

Further Exemplary Embodiments

Materials and Methods:

To fabricate the present inventors' microfluidics devices, the inventors firstly used negative photoresist to form a negative mold through standard soft lithography technique. Both SU-8 50 and SU-8 10 were patterned on a silicon wafer to form channels whose smallest feature is 25 μm. The height of channels and grooves were 50 μm and 10 μm respectively. After the mold was fabricated, the inventors spin-coated a mixture of 10 to 1 ratio Polydimethylsiloxane prepolymer and corresponding curing agent at 600 rpm for 1 min to get a 100 μm PDMS channel layer. It could fully cure after 24 hours in the incubator at 60° C. Next step was to peel PDMS layer off the wafer and to form a sandwich structure with two slices of cover glasses. Using 02-plasma could change the surface of PDMS from hydrophobic to hydrophilic for permanent bonding with glass slides. One of the glass slides with three laser-drilled holes (slide A) would be attached to the featureless side of PDMS layer and the other (slide B) would be bonded to the featured side of PDMS layer. Three holes serve as one inlet and two outlets, one for concentrated sample and the other for the rest solution. Finally, three PDMS 3-5 mm thick blocks would be bonded to the glass slides with holes for tubing to insert in.

Figure 15A:
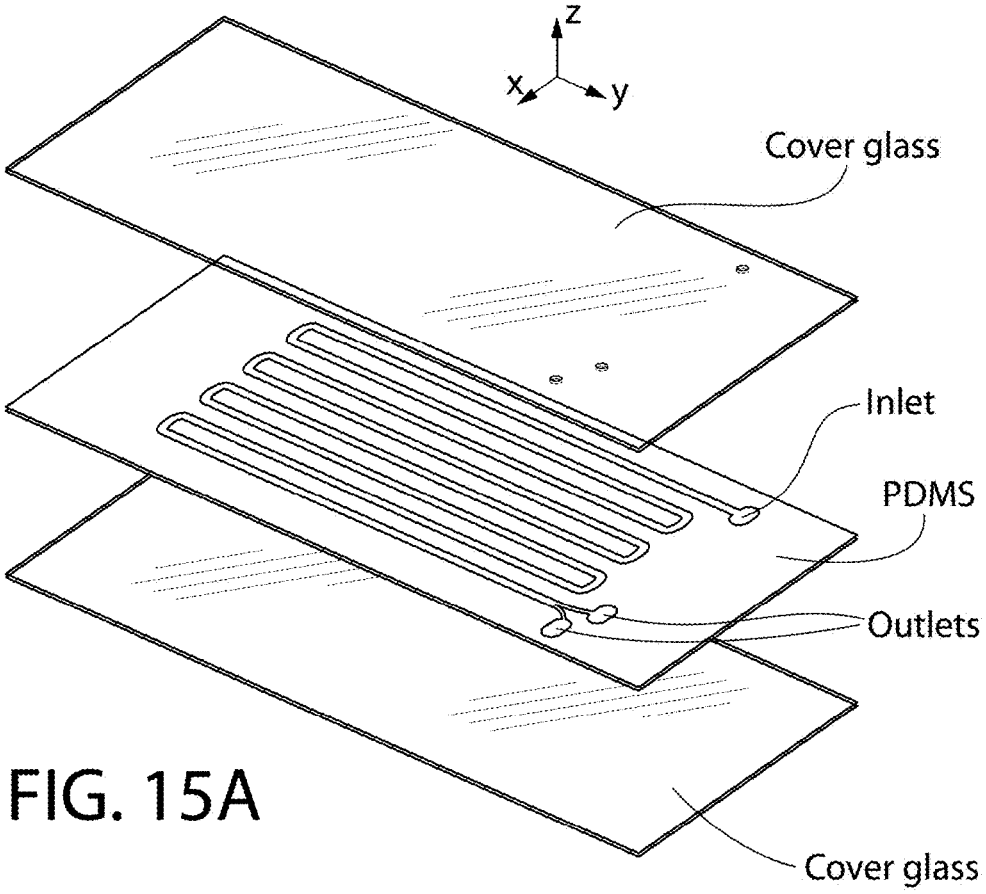
FIG. 15A is an exploded view of a schematic illustrating a device used in an embodiment. A middle PDMS layer with engraved grooves is sandwiched between two glass cover slides to form the microfluidic channel.

FIG. 15A is an exploded view of a schematic illustrating a device used in an embodiment. A middle PDMS layer with engraved grooves is sandwiched between two glass cover slides to form the microfluidic channel.

Figure 15B:
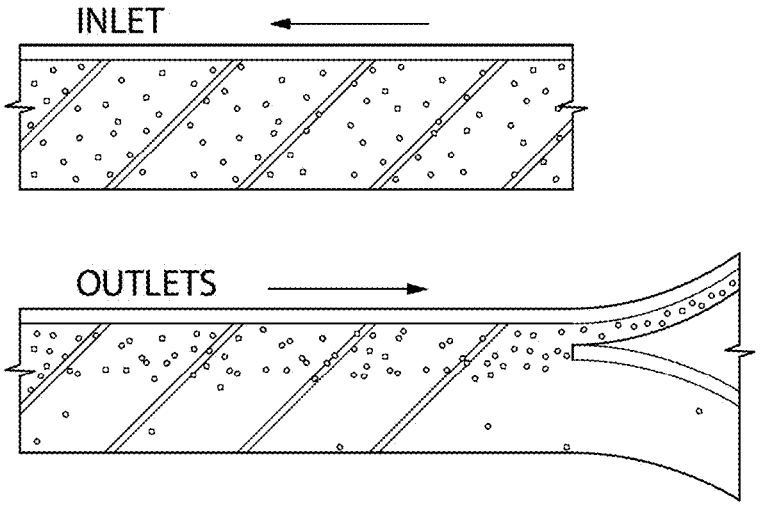
FIG. 15B is an enlarged schematic illustrating uniform nanoparticle distribution at the inlet, and concentrated to a corner near the outlet.

FIG. 15B is an enlarged schematic illustrating uniform nanoparticle distribution at the inlet, and concentrated to a corner near the outlet.

Figure 15C:
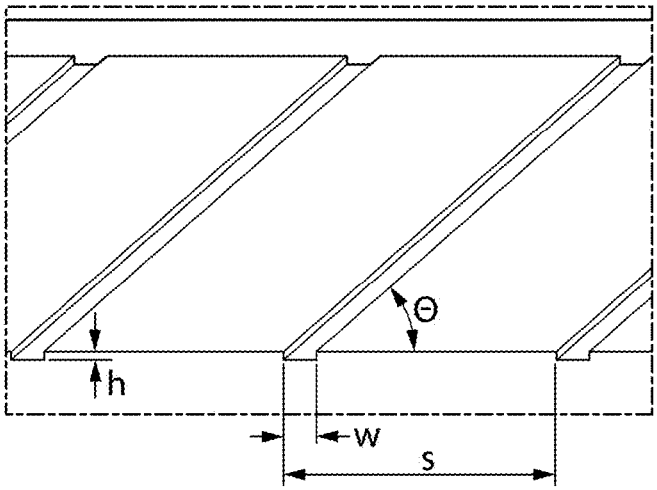
FIG. 15C is a schematic illustrating a detailed structure of the microchannel with engraved microgrooves on the floor.

FIG. 15C is a schematic illustrating a detailed structure of the microchannel with engraved microgrooves on the floor.

Figure 15D:
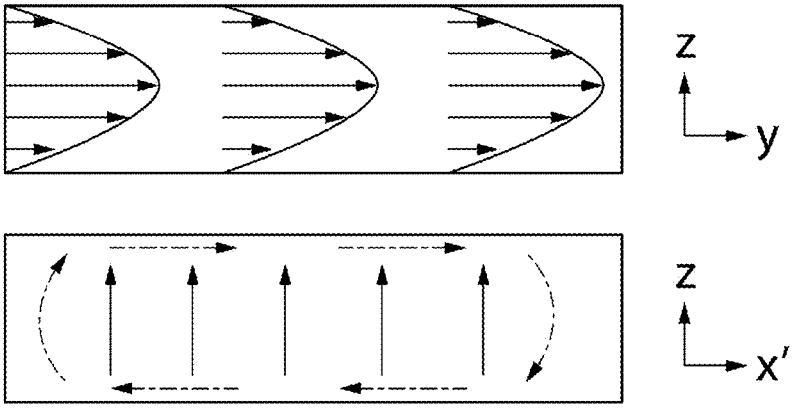
FIG. 15D is a plot illustrating engineered transport processes that produce nanoparticle concentration: axial convection (top panel), transverse thermophoresis (solid black arrows of bottom panel) and recirculation (dashed arrows in bottom panel).

FIG. 15D is a plot illustrating engineered transport processes that produce nanoparticle concentration: axial convection (top panel), transverse thermophoresis (solid black arrows of bottom panel) and recirculation (dashed arrows in bottom panel).

To establish the temperature gradients, two setups were used. For confocal imaging, a liquid circulator with coolant was connected to a metal pipe contacting the roof of the device. The coolant temperature was set to values between −12° C. and room temperature. At the same time, an air circulator keeps the device floor at near room temperature. The temperature gradient was confirmed by a temperature sensitive dye BCECF (2',7'-Bis-(2-Carboxyethyl)-5-(and-6)-Carboxyfluorescein) at 1 mM in DI water under confocal imaging. To collect outflow from the device, the roof and floor of the device was brought into contact with two Peltier plates, set to −4° C. and 23° C., respectively. Nanoparticle focusing in the microchip was first demonstrated using 0.1% (v/v) 100 nm polystyrene fluorescent particles, through both in situ fluorescence intensity imaging and off-chip UV-Vis absorption spectroscopy measurements. Afterwards, concentration of HIV virions was tested using both biochemical and infectivity tests.

After a trial and error process for determination of optimum flow conditions, off-microscope measurements were also applied for a continuous outflow collection. Peltier plates were used for temperature gradient establishment instead of a cooling tube and air circulator. According to the previous study, once becoming negative, the Soret coefficient will further deviate from zero as temperature reduces, which means the lower temperature the inventors could achieve, the better focusing effect will result. In order to make a compromise between the freezing point of the inner-flowing liquid and high Soret coefficient, the inventors set the temperature range over the present inventors' sandwiched device to be −10~16 Celsius. Meanwhile, since concentrated species will only occupy one corner of the channel from a transverse view. A proper separation method is needed to get rid of the rest solution. By designing a width of the channel, the resistance of the channel can be manipulated. Therefore, a bifurcated 1:10 width ratio outlet was designed to separate concentrated particles from the buffer solution. Two 5 mm thick PDMS wells together with a reservoir full of water were positioned at two outlets for both collection and evaporation preventing purposes. Both 100 nm polystyrene fluorescent particles and viruses were tested using this experimental setup.

Figure 16A:
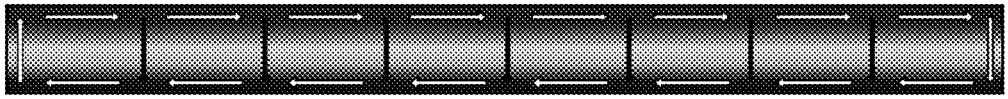
FIG. 16A is a plot illustrating a cross-sectional view along the groove that shows coupling of two physical processes. White arrows indicate advection flow and black arrows refer to thermophoretic transport.

FIG. 16A is a plot illustrating a cross-sectional view along the groove that shows coupling of two physical processes. White arrows indicate advection flow and black arrows refer to thermophoretic transport.

Figure 16B:
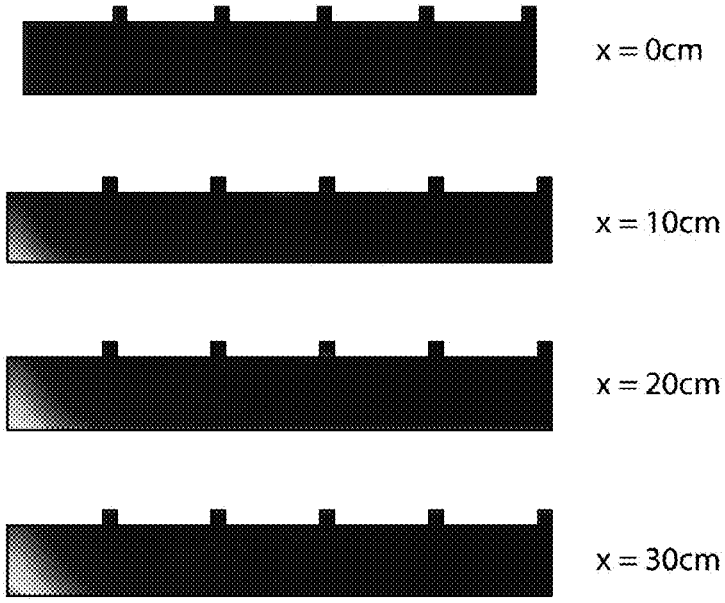
FIG. 16B is a plot illustrating how different positions along the channel have different concentration effects, which demonstrates that the focusing effect is developed along a channel axial length.

FIG. 16B is a plot illustrating how different positions along the channel have different concentration effects, which demonstrates that the focusing effect is developed along a channel axial length.

To understand and verify the transport process that controls nanoparticles concentration, numerical analysis was applied through continuous phase model. Two physics fields were coupled to get a focusing effect. One of them is heat transfer in fluids, which corresponds to the conservation of energy and can be described by the following equations:

$$\rho C_p u \cdot \nabla T + \nabla \cdot (-k \cdot \nabla T) = 0 \quad (5)$$

where ρ is the density if the fluid, $C_p$ is the heat capacity of the fluid, k is the thermal conductivity of the fluid, u is the fluid velocity and T is the initial temperature. The first term of equation (5) above stands for heat transfer of convection flow and the second term refers to natural heat conduction.

Despite energy conservation, mass and momentum conservation also plays an important role, as per equations 6 and 7 below:

$$\nabla \cdot (\rho u) = 0 \quad (6)$$

$$u \cdot \nabla u = -\frac{1}{\rho} \nabla p + \gamma \nabla^2 u + \alpha g (T - T_0) \quad (7)$$

where γ is kinematic viscosity, α is the thermal expansion coefficient of the fluid, g is gravitational acceleration, $T_0$ is the reference temperature for which the fluid density is evaluated and T is the temperature.

In the present inventors' mass transport process, mass diffusion, advection and the effect of thermophoresis are coupled together to approach a concentration effect as per equation 8:

$$\nabla \cdot (D_T c \nabla T + D \nabla c) - \nabla \cdot (uc) = 0 \quad (8)$$

where D is diffusion coefficient and $D_T$ is thermophoretic coefficient. The first term stands for thermophoresis effect, the second represents diffusion effect and the last term corresponds to advection phenomena.

Such Multiphysics fields coupling was implemented using COMSOL. The geometry of channels is exactly the same with experimental ones. Since direct measurement of the temperature gradient across the channel cannot be achieved, estimation based on fluorescent intensity was made. 2-D image of channels' cross-section led us to the conclusion of $D_T \cdot \nabla T = 0.16$ μm/s. As a result, $D_T$ was set to 0.81e-12 $m^2$/K·s, ΔT was set to 10° C., D was set to 4.4 $\mu m^2$/s and gravitational acceleration was set at 9.8 $m/s^2$. For the material, viscosity of water is 0.001 Pa·s, density is 1000 $kg/m^3$, heat capacity is 4.2 J/g·K and thermal conductivity is 0.6 W/m·K. The concentration factor was got through dividing average concentration over one tenth of the whole cross-section of the channel by the average of the whole channel.

Results:

Continuous concentration of nanoparticles is realized by coupling a helical flow with a directional transport: the directional transport along the microchannel gap pushes nanoparticles to the ceiling, which are swept by the helical flow to a corner while moving towards the outlet. The three-dimensional helical flow is introduced by slanted grooves patterned on the microchannel floor, which are often used for chaotic mixing. A detailed structure of the device is shown in FIG. 15C. Based on results from numerical optimization, the height (h), width (w), spacing (s) and angle of the slanted microgrooves are 10 μm, 25 μm, 200 μm and 45° respectively. The shallow and well-spaced grooves create gentle transverse flow to promote nanoparticle focusing to a corner, while minimize recirculation. The channel width (W), height (H) and length are 1 mm, 50 μm and 28.8 cm respectively. The channel is constructed in a thin film of PDMS at 100 μm, and the PDMS film is sandwiched between two glass coverslips/coverglasses/coverslides.

To demonstrate experimentally that shallow grooves on the channel floor introduce transverse convection as a subcomponent of the axial flow, a solution of fluorescein and water are injected through the outlet to establish a side by side flow at a mean axial velocity of 1 mm/s. Compared to a channel with smooth floors and operated under the same axial velocity, fluorescein in the grooving device shows a significant lateral migration from confocal images (FIG. 2). The mean transverse velocity is found to be ~30 μm/s, matching the prediction from the simulation for the selected structure.

Figure 17A:
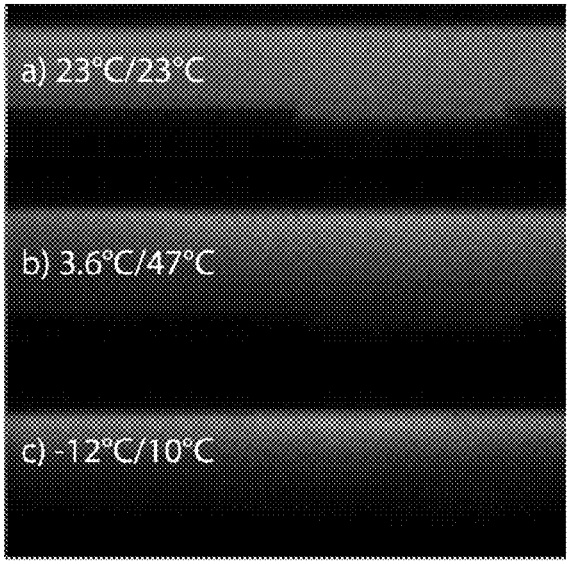
FIG. 17A is a plot illustrating fluorescence intensity in a cross-sectional plane showing distribution of 100 nm polystyrene particles under different temperature gradients.

FIG. 17A is a plot illustrating fluorescence intensity in a cross-sectional plane showing distribution of 100 nm polystyrene particles under different temperature gradients.

Figure 17B:
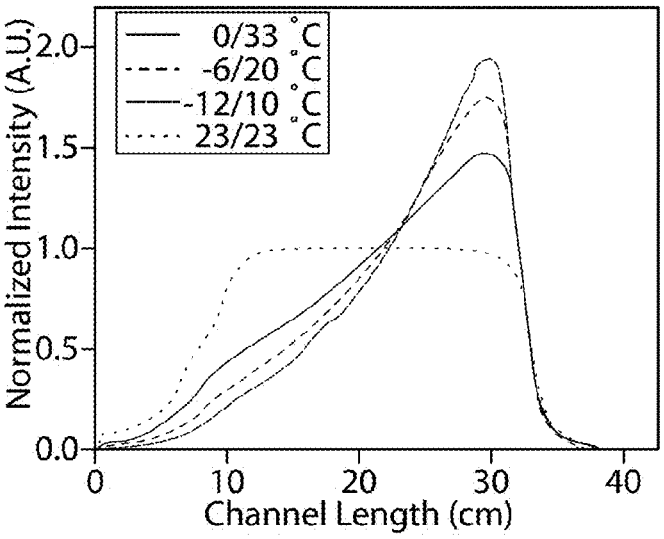
FIG. 17B is a plot illustrating normalized fluorescence intensity in the z-direction.

FIG. 17B is a plot illustrating normalized fluorescence intensity in the z-direction.

The directional transport was introduced through thermophoresis under a temperature gradient. For confocal imaging, the temperature gradient was established using a cooling pipe in contact with the roof and forced air flow below the device floor. Considering thermal conductance of the various layers, temperature difference in the PDMS channel is ~12% of that between the heat sink and source. To confirm establishment of the temperature gradient and thermophoresis, the microchannel was filled with a suspension containing 0.1% 100 nm polystyrene particles. Preferential distribution of nanoparticles to the device roof is observed in FIG. 17A. Fluorescence intensity decays exponentially in the vertical direction (FIG. 17B), matching theoretical prediction of mass transport by thermophoresis and natural diffusion. Furthermore, vertical redistribution is controlled by both the absolute temperature difference and the range of temperature.

According to experimental results, the distribution of fluorescent particles along z direction is related to two factors. One is a temperature gradient, the steeper it is, more concentrated particles will be. The other is the location of the temperature range—if the whole temperature range shifts to a lower value, absolute value of Soret coefficient will get larger, which could lead to a more significant focusing phenomena. Note that the temperature of the cold side of the thermal column has a greater impact on fluorescent intensity profile in the z-direction, it is due to the variation of Soret coefficient. According to prior literature, there will be a dramatic increase of Soret coefficients with a decrease of temperature near the water freezing point. Such a variation has been attributed to water hydration entropy.

In the following longer time-period flow experiment, a −6~23 Celsius temperature range was used for imaging purposes. Such a compromise was made based on relatively decent corresponding thermophoresis phenomena and negligible condensation or freezing effect because of low temperature. Despite channel geometry, the focusing effect is also related to axial flow rate, flow time period and channel length.

Figure 18A:
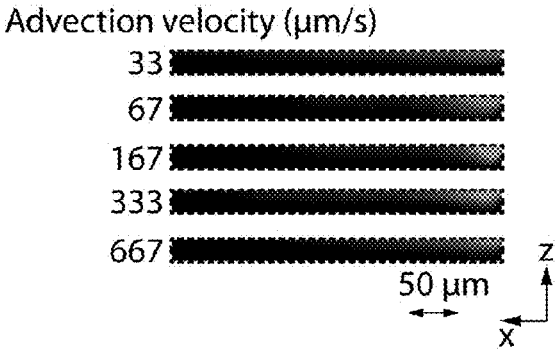
FIG. 18A is a plot illustrating fluorescent intensity in the x-z cross-section at different axial flow velocity near the device outlet.

FIG. 18A is a plot illustrating fluorescent intensity in the x-z cross-section at different axial flow velocity near the device outlet.

Figure 18B:
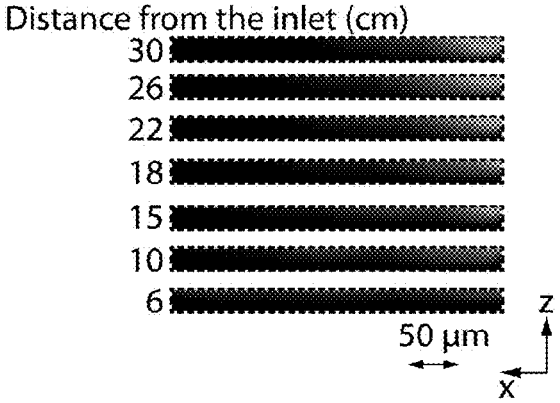
FIG. 18B is a plot illustrating fluorescent intensity in the x-z cross-section at distance from the device inlet. The axial velocity is 167 μm/s.

FIG. 18B is a plot illustrating fluorescent intensity in the x-z cross-section at distance from the device inlet. The axial velocity is 167 μm/s.

Figure 18C:
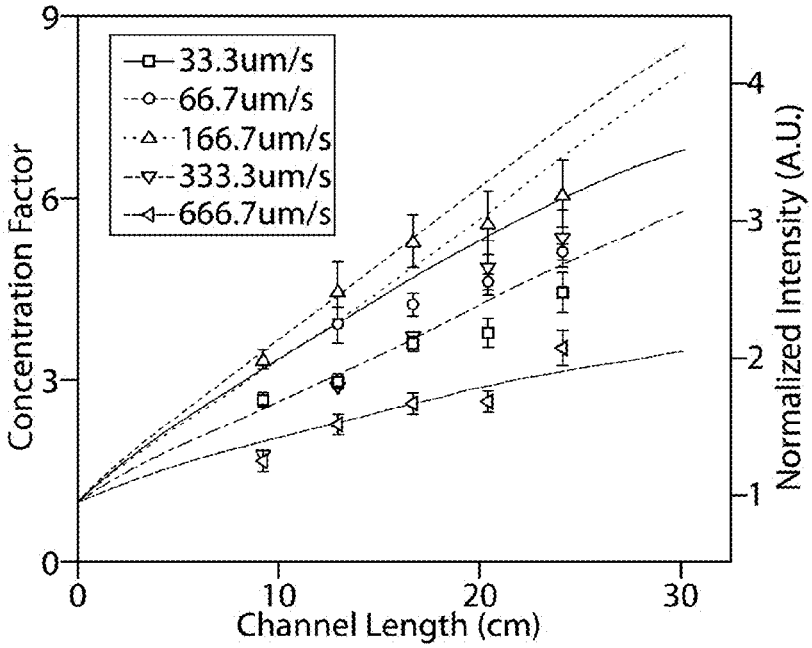
FIG. 18C is a plot illustrating concentration factor of different flow rates along the channel length. Solid lines are simulation data and dots with error bars are experimental data.

FIG. 18C is a plot illustrating concentration factor of different flow rates along the channel length. Solid lines are simulation data and dots with error bars are experimental data.

FIG. 18A shows cross-sectional nanoparticle distribution near the device outlet. At the optimal axial velocity of 167 μm/s, nanoparticles focus tightly to the top-left corner in the cross-section. Away from the optimal velocity, nanoparticle distribute more evenly along the device width. The focusing effect established along the axial flow (FIG. 18B). The fluorescence intensity change along the channel length (discrete symbols in FIG. 18C) is in general agreement with the simulation prediction (lines in FIG. 18C). The lines and symbols are identified for each flow rate.

Figure 19:
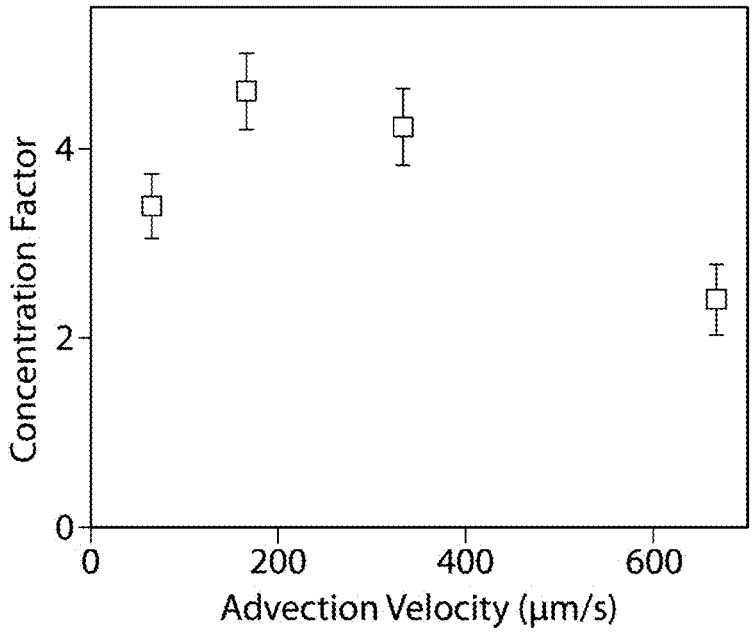
FIG. 19 is a plot illustrating off-chip concentration measurements of the outflow concentration based on UV-vis absorption spectroscopy.

FIG. 19 is a plot illustrating off-chip concentration measurements of the outflow concentration based on UV-vis absorption spectroscopy.

As is discussed above, concentration factor is critically dependent on flow rate, developing time and channel length given a specific channel geometry. The maximum concentration could be achieved at 1:1 thermophoretic velocity and sweeping flow ratio in a sufficiently long channel for long enough time—to let thermophoretic motion, swirling motion and diffusion get balanced. However, some compromises need to be made for particle application. Instead of using 0.2 μl/min (66.67 μm/s axial velocity), the inventors prefer a higher velocity, say, 166.67 μm/s for the convenience of outlet flow collection and reduction of steady state developing time at the expense of a lower concentration factor. One huge advantage of the present inventors' device is that sample can continuously flow through, which leads to an easy, continuous collection from the outlet. Since fluorescence imaging only provides qualitative results, the concentration factors were measured from samples collected the outlets. Two outlets were created with a width difference of 1:9, and most nanoparticles are expected to exit from the narrow end. Concentration from the narrow end was further normalized to the input concentration. Using an axial velocity of 166.67 μm/s, the concentration factor from the narrow outlet was found to be 4.5 compared to the inflow (FIG. 19).

Figure 20:
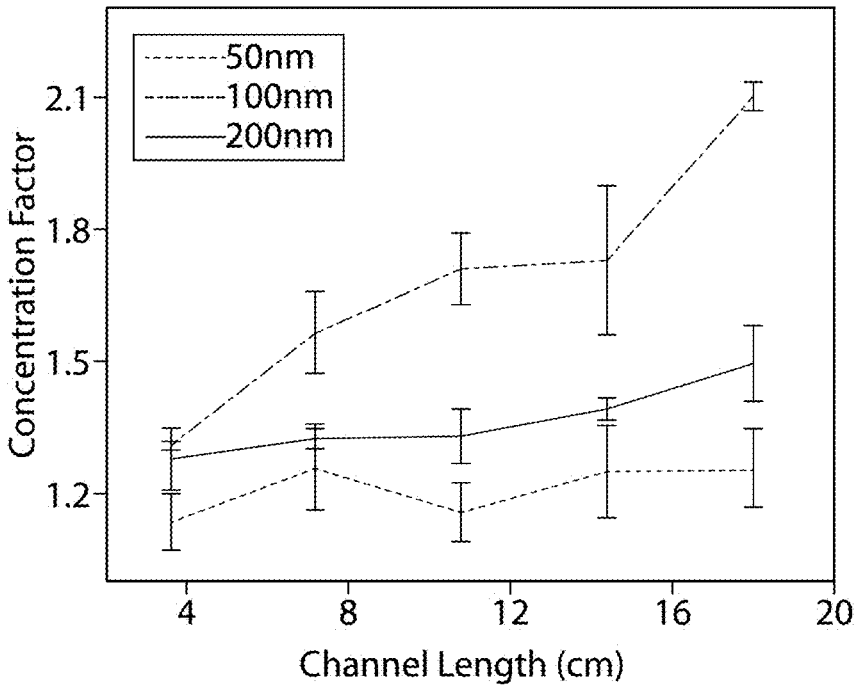
FIG. 20 is a plot illustrating different concentration factors for different sizes of particles under the same 666.67 μm/s axial velocity after 30 min of flowing.

FIG. 20 is a plot illustrating different concentration factors for different sizes of particles under the same 666.67 μm/s axial velocity after 30 min of flowing.

Through the verification of both virus and 100 nm fluorescent particles, a labeling free, continuous flow nanoparticle focusing method has been proved to be effective. Conservatively speaking, the concentration factor could be 4 times at an axial velocity of 166.67 μm/s. Besides, the separation effect based on different particle sizes were also explored. 50 nm, 100 nm, and 200 nm particles will have different concentration effects under the same condition, as is shown in FIG. 20.

Figure 21A:
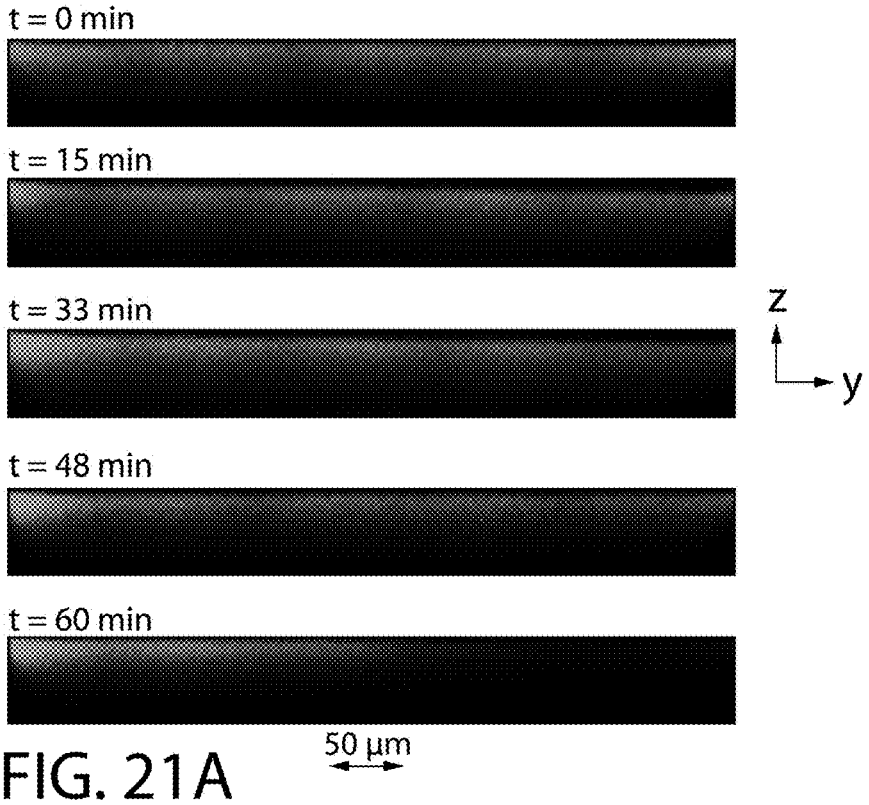
FIG. 21A is a plot illustrating images showing fluorescent intensity distribution at different time points after flow at the same location of x=21.6 cm. This embodiment depicts distribution of 100 nm polystyrene particles at different time and distances from the inlet. The temperature difference across the sandwiched devices was 22° C. and the inflow flow rate was 0.2 μl/min.

FIG. 21A is a plot illustrating images showing fluorescent intensity distribution at different time points after flow at the same location of x=21.6 cm. This embodiment depicts distribution of 100 nm polystyrene particles at different time and distances from the inlet. The temperature difference across the sandwiched devices was 22° C. and the inflow flow rate was 0.2 μl/min (average axial velocity of 66.7 μm/s).

Figure 21B:
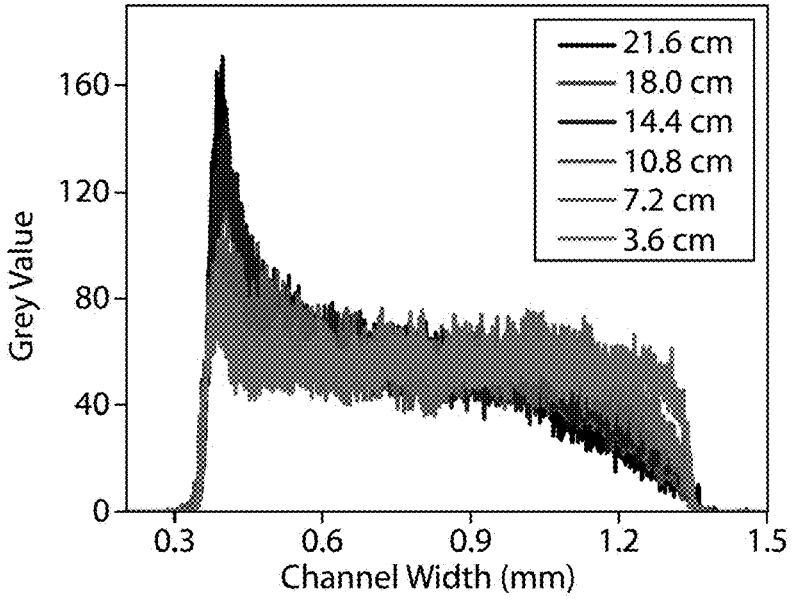
FIG. 21B is a plot illustrating fluorescence intensity in evenly spaced planes from the inlet to the outlet, showing gradual accumulation of fluorescent particles to the left side. This embodiment depicts distribution of 100 nm polystyrene particles at different distances from the inlet. The temperature difference across the sandwiched devices was 22° C. and the inflow flow rate was 0.2 μl/min.

FIG. 21B is a plot illustrating fluorescence intensity in evenly spaced planes from the inlet to the outlet, showing gradual accumulation of fluorescent particles to the left side. This embodiment depicts distribution of 100 nm polystyrene particles at different distances from the inlet. The temperature difference across the sandwiched devices was 22° C. and the inflow flow rate was 0.2 μl/min (average axial velocity of 66.7 μm/s).

Figure 22:
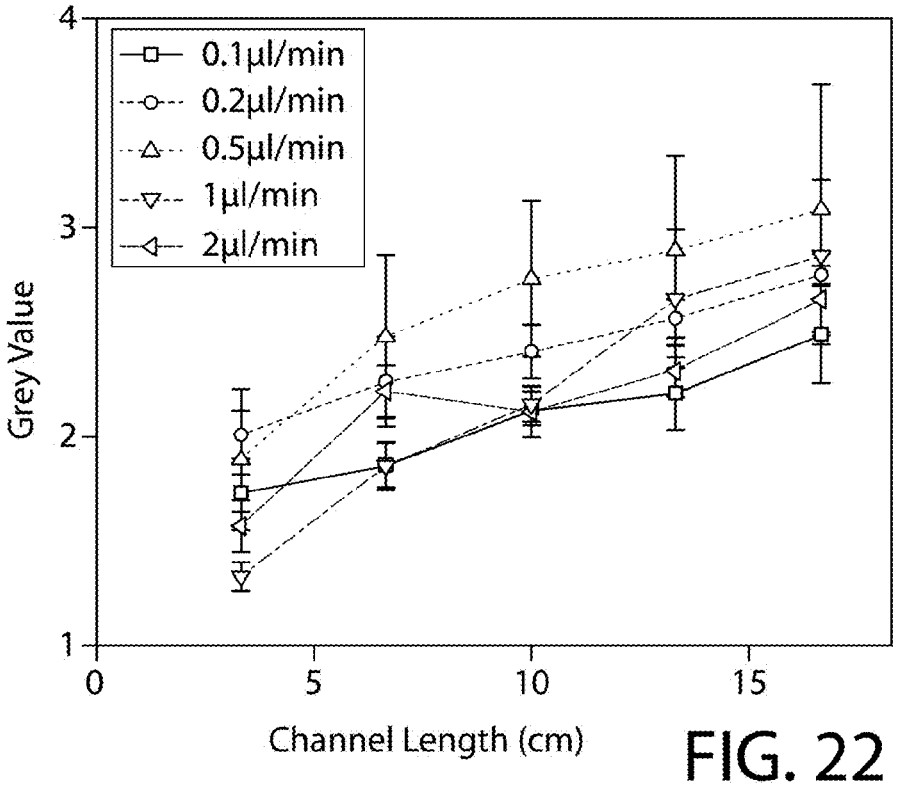
FIG. 22 is a plot illustrating normalized fluorescence intensity along the flow direction (x direction) at different flow rates. Maximum accumulation was observed when the flow rate was 0.5 μl/min.

FIG. 22 is a plot illustrating normalized fluorescence intensity along the flow direction (x direction) at different flow rates. Maximum accumulation was observed when the flow rate was 0.5 μl/min (average axial velocity of 166.7 μm/s).

Figure 23:
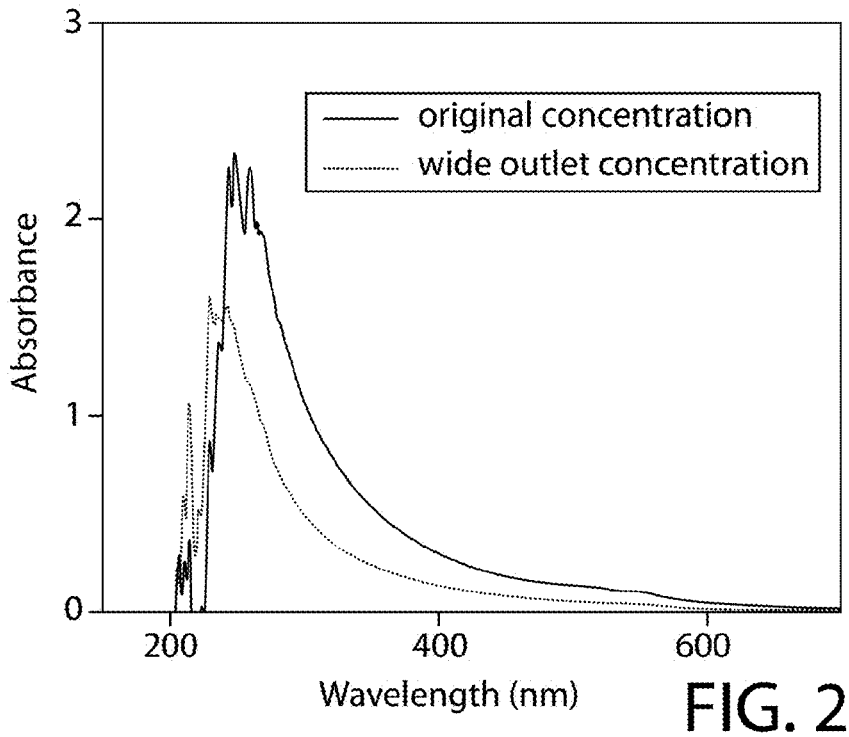
FIG. 23 is a plot illustrating absorbance spectra from the original sample and outflow from the solvent outlet. Concentration from the solvent outlet is 20% of the original, or the narrower outlet has an enrichment of 8 times.

FIG. 23 is a plot illustrating absorbance spectra from the original sample and outflow from the solvent outlet. Concentration from the solvent outlet is 20% of the original, or the narrower outlet has an enrichment of 8 times.

Although embodiments are described above with reference to temperature control devices that apply a one-dimensional temperature gradient to the channel, the temperature control device described in any of the above embodiments may alternatively comprise a temperature control device that applies a non-one-dimensional temperature gradient to the channel. Such alternatives are considered to be within the spirit and scope of the present invention, and may therefore utilize the advantages of the configurations and embodiments described above.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. An apparatus comprising:

a microfluidic channel device comprising a main body comprising a channel configured to provide for helical fluid motion of material within the channel; and a temperature control system that applies a temperature gradient to the channel;

wherein the channel comprises microgrooves that initiate and maintain the helical fluid motion of the material within the channel, and the channel is between 500 to 2000 μm in width, between 50 to 100 μm in height, and between 1 to 40 cm in length;

wherein the apparatus is configured such that the material undergoes thermophoresis and swirling transport, which are induced by said microgrooves over a surface of the microfluidic channel.

2. The apparatus according to claim 1, wherein the channel further comprises a rectangular cross-section that is perpendicular to a longitudinal directional of the channel.

3. The apparatus according to claim 2, wherein the channel further comprises a bottom surface and a top surface, and wherein the microgrooves are located at the bottom surface or the top surface.

4. The apparatus according to claim 1, wherein the microgrooves are spaced from each other a distance of 100 to 400 μm, and wherein each microgroove is between 10 to 60 μm in height, between 10 to 100 μm in width, and is oriented at an angle between 25 to 65° with respect to a longitudinal direction of the channel.

5. The apparatus according to claim 1, wherein the microfluidic channel device further comprises:

a bottom coverglass that covers a bottom surface of the main body; and a top coverglass that covers a top surface of the main body;

wherein an inlet and outlet of the channel is provided in at least one of the bottom coverglass or the top coverglass.

6. The apparatus according to claim 1, wherein the temperature control system comprises a liquid coolant circulator coupled to a pipe in contact with a top or bottom surface of the microfluidic channel device.

7. The apparatus according to claim 1, wherein the temperature control system comprises:

a bottom Peltier plate in contact with a bottom surface of the microfluidic channel device; and a top Peltier plate in contact with a top surface of the microfluidic channel device.

8. The apparatus according to claim 7, wherein the bottom Peltier plate is set to a temperature in the range of −12 to 10° C., and wherein the top Peltier plate is set to a temperature in the range of 23 to 50° C.

9. A method of using an apparatus, the method comprising:

providing a microfluidic channel device comprising a main body comprising a channel configured to provide for helical fluid motion of material within the channel;

providing a continuous flow of the material within the channel; and applying a temperature gradient to the channel using a temperature control system; causing the material to undergo thermophoresis and swirling transport as it flows through the channel; and wherein the channel comprises microgrooves that initiate and maintain the helical fluid motion of the material within the channel, and the channel is between 500 to 2000 μm in width, between 50 to 100 μm in height, and between 1 to 40 cm in length.

10. The method according to claim 9, wherein the channel further comprises a rectangular cross-section that is perpendicular to a longitudinal directional of the channel.

11. The method according to claim 10, wherein the channel further comprises a bottom surface and a top surface, and wherein the microgrooves are located at the bottom surface or the top surface.

12. The method according to claim 9, wherein the microgrooves are spaced from each other a distance of 100 to 400 μm, and wherein each microgroove is between 10 to 60 μm in height, between 10 to 100 μm in width, and is oriented at an angle between 25 to 65° with respect to a longitudinal direction of the channel.

13. The method according to claim 9, wherein the microfluidic channel device further comprises:

a bottom coverglass that covers a bottom surface of the main body; and a top coverglass that covers a top surface of the main body;

wherein an inlet and outlet of the channel is provided in at least one of the bottom coverglass or the top coverglass.

14. The method according to claim 9, wherein the temperature control system comprises a liquid coolant circulator coupled to a pipe in contact with a top or bottom surface of the microfluidic channel device.

15. The method according to claim 9, wherein the temperature control system comprises:

a bottom Peltier plate in contact with a bottom surface of the microfluidic channel device; and a top Peltier plate in contact with a top surface of the microfluidic channel device.

16. The method according to claim 15, wherein the method further comprises:

setting a temperature in the range of −12 to 10° C. for the bottom Peltier plate; and setting a temperature in the range of 23 to 50° C. for the top Peltier plate.

* * * * *